US010566689B2

(12) United States Patent
Svendsen et al.

(10) Patent No.: US 10,566,689 B2
(45) Date of Patent: Feb. 18, 2020

(54) ANTENNA SYSTEM

(71) Applicant: Intel IP Corporation, Santa Clara, CA (US)

(72) Inventors: Simon Svendsen, Aalborg (DK); Ole Jagielski, Frederikshavn (DK); Pevand Bahramzy, Norresundby (DK); Finn Hausager, Aabybro (DK)

(73) Assignee: Apple Inc., Cupertino, CA (US)

( * ) Notice: Subject to any disclaimer, the term of this patent is extended or adjusted under 35 U.S.C. 154(b) by 999 days.

(21) Appl. No.: 14/865,829

(22) Filed: Sep. 25, 2015

(65) Prior Publication Data

US 2017/0093031 A1 Mar. 30, 2017

(51) Int. Cl.

| | |
|---|---|
| ***H01Q 1/50*** | (2006.01) |
| ***H01Q 5/20*** | (2015.01) |
| ***H01Q 1/38*** | (2006.01) |
| ***H01Q 9/04*** | (2006.01) |

(52) U.S. Cl.
CPC ..... *H01Q 1/50* (2013.01); *H01Q 1/38* (2013.01); *H01Q 5/20* (2015.01); *H01Q 9/0442* (2013.01)

(58) Field of Classification Search
CPC ..... H01Q 1/50; H01Q 9/0442
See application file for complete search history.

(56) References Cited

U.S. PATENT DOCUMENTS

| | | | | |
|---|---|---|---|---|
| 4,621,243 | A | 11/1986 | Harada | |
| 5,661,493 | A | 8/1997 | Uher et al. | |
| 6,333,719 | B1 | 12/2001 | Varadan et al. | |
| 6,396,456 | B1 | 5/2002 | Chiang et al. | |
| 6,639,491 | B2 | 10/2003 | Toncich | |
| 10,205,232 | B2 * | 2/2019 | Sayama | H01Q 1/523 |
| 2004/0263408 | A1 | 12/2004 | Sievenpiper et al. | |
| 2005/0014474 | A1 | 1/2005 | Jitsukawa et al. | |
| 2010/0001907 | A1 | 1/2010 | Wan | |
| 2012/0045006 | A1 | 2/2012 | Chuang et al. | |
| 2013/0278477 | A1 * | 10/2013 | Dupuy | H01Q 1/50 343/852 |

(Continued)

OTHER PUBLICATIONS

International Search Report dated Oct. 31, 2016 for PCT International Application No. PCT/US2016/048172.

*Primary Examiner* — Jessica Han
*Assistant Examiner* — Amal Patel
(74) *Attorney, Agent, or Firm* — Eschweiler & Potashnik, LLC

(57) ABSTRACT

Described are an antenna system for wireless communication and a method of configuration thereof. The antenna system can include a first radiator having a first resonance frequency, a second radiator having a second resonance frequency different from the first resonance frequency, a first electromagnetic coupler associated with the first radiator and a first frontend, a second electromagnetic coupler associated with the second radiator and a second frontend, and a switch. The switch can be configured to connect the first electromagnetic coupler and the second electromagnetic coupler in an inter antenna aggregation configuration in a first mode of operation. The switch can also be configured to connect the first electromagnetic coupler and the second electromagnetic coupler in an intra antenna aggregation configuration in a second mode of operation.

20 Claims, 11 Drawing Sheets

(56) References Cited

U.S. PATENT DOCUMENTS

| | | | | |
|---|---|---|---|---|
| 2014/0342678 | A1* | 11/2014 | Khlat | H04L 5/001 455/78 |
| 2015/0048991 | A1* | 2/2015 | Pajona | H01Q 7/00 343/852 |
| 2016/0276748 | A1* | 9/2016 | Ramachandran | H01Q 21/28 |

* cited by examiner

ANTENNA SYSTEM

BACKGROUND

Field

Aspects described herein generally relate to antennas, including dual coupled and dual element antenna systems.

Related Art

Wireless communication environments can use multi-antenna techniques that include multiple antennas at a transmitter, receiver, and/or transceiver. The multi-antenna techniques can be grouped into three different categories: diversity, interference suppression, and spatial multiplexing. These three categories are often collectively referred to as Multiple-input Multiple-output (MIMO) communication even though not all of the multi-antenna techniques that fall within these categories require at least two antennas at both the transmitter and receiver.

Carrier Aggregation (CA) is a feature of a mobile communication standard, such as, Release-10 of the 3GPP LTE-Advanced standard, which allows multiple resource blocks from/to multiple respective serving cells to be logically grouped together (aggregated) and allocated to the same wireless communication device. The aggregated resource blocks are known as component carriers (CCs) in the LTE-Advanced standard. Each of the wireless communication devices may receive/transmit multiple component carriers simultaneously from/to the multiple respective serving cells, thereby effectively increasing the downlink/uplink bandwidth of the wireless communication device(s). The term "component carriers (CCs)" is used to refer to groups of resource blocks (defined in terms or frequency and/or time) of two or more RF carriers that are aggregated (logically grouped) together.

There are various forms of Carrier Aggregation (CA) as defined by Release-10 of the LTE-Advanced standard, including intra-band contiguous (adjacent) CA, intra-band non-contiguous (non-adjacent) CA, and inter-band CA. In intra-band contiguous CA, aggregated component carriers (CCs) are within the same frequency band and adjacent to each other forming a contiguous frequency block. In intra-band non-contiguous CA, aggregated CCs are within the same frequency band but are not adjacent to each other. In inter-band CA, aggregated CCs are in different frequency bands.

BRIEF DESCRIPTION OF THE DRAWINGS/FIGURES

The accompanying drawings, which are incorporated herein and form a part of the specification, illustrate the aspects of the present disclosure and, together with the description, further serve to explain the principles of the aspects and to enable a person skilled in the pertinent art to make and use the aspects.

The exemplary aspects of the present disclosure will be described with reference to the accompanying drawings. The drawing in which an element first appears is typically indicated by the leftmost digit(s) in the corresponding reference number.

DETAILED DESCRIPTION

In the following description, numerous specific details are set forth in order to provide a thorough understanding of the aspects of the present disclosure. However, it will be apparent to those skilled in the art that the aspects, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

Figure 1A:
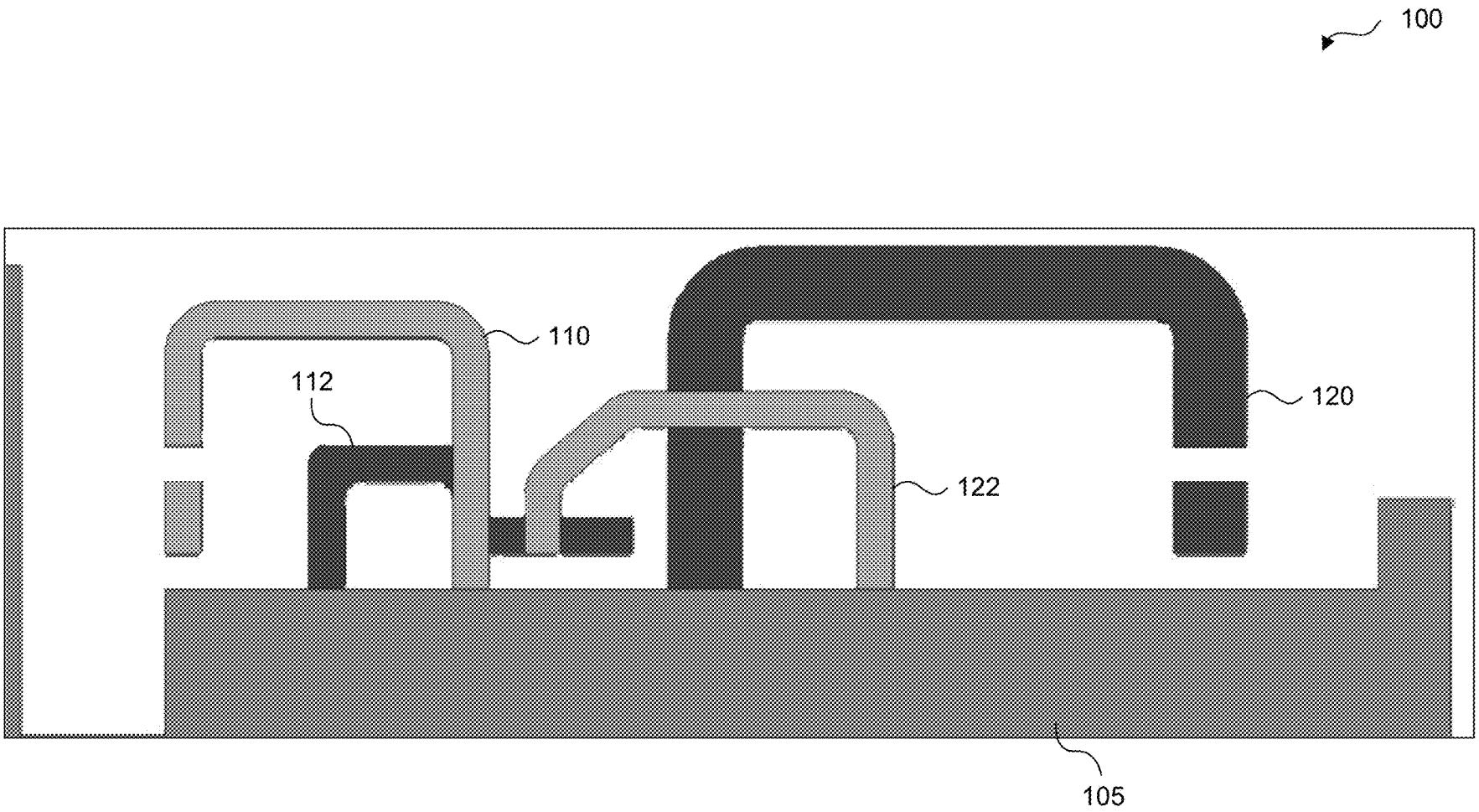
FIG. 1A illustrates a top view of an antenna system according to an exemplary aspect of the present disclosure.

FIG. 1A illustrates a top view of an antenna system 100 according to an exemplary aspect of the present disclosure. The antenna system 100 can include first and second radiators 110 and 120, and first and second electromagnetic couplers 112 and 122 in a dual coupled, dual element (DCDE) configuration. The radiators 110 and 120 can be configured to convert one or more electrical signals into electromagnetic waves, and vice versa.

One or more of the electromagnetic couplers 112 and 122 can be configured to connect (e.g., couple) one or more communication devices (e.g., transmitter and/or receiver) to one or more of the radiators. For example, the first electromagnetic coupler 112 can be configured connect a first radio frequency (RF) frontend to the first radiator 110. Similarly, the second electromagnetic coupler 122 can be configured connect a second RF frontend to the second radiator 120. In an exemplary aspect, and as discussed in more detail below, the first and second electromagnetic couplers 112 and 122 can be connected together and to one of the first and second RF frontends. In this example, the connected RF frontend can be coupled to both the first and second radiators 110 and 120, where the first radiator 110 can have a first resonance frequency and the second radiator 120 can have a second, different resonance frequency. For the purpose of this discussion, a frontend (or RF frontend) can include processor circuitry configured to process one or more incoming and/or outgoing signals. A frontend can include, for example, a digital signal processer (DSP), modulator and/or demodulator, a digital-to-analog converter (DAC) and/or an analog-to-digital converter (ADC), a frequency converter (including mixers, local oscillators, and filters), and/or one or more other components for processing RF, intermediate frequency (IF) and/or other signals as would be understood by those skilled in the relevant arts.

One or more of the electromagnetic couplers 112 and 122 can include one or more circuits having one or more active and/or passive components that are configured to match the impedance of one or more of the radiators 110 and 120. For example, the electromagnetic couplers 112 and/or 122 can be inductive couplers that are configured to inductively couple one or more of the radiators 110 and 120 to one or more communication devices (e.g., transmitter, receiver, etc.). The electromagnetic couplers 112 and 122 are not limited to being inductive couplers and can be configured as capacitive couplers that can capacitively couple one or more of the radiators 110 and 120. In an exemplary aspect, the antenna system 100 can be configured as a transmission antenna system, as a receiving antenna system or as both a transmitting and receiving antenna system. Further, two or more of the antenna systems 100 can be implemented within, or used by, a communication device, where, for example, one antenna system 100 is configured as a transmission antenna system and another antenna system 100 is configured as a receiving antenna system.

Figure 2A:
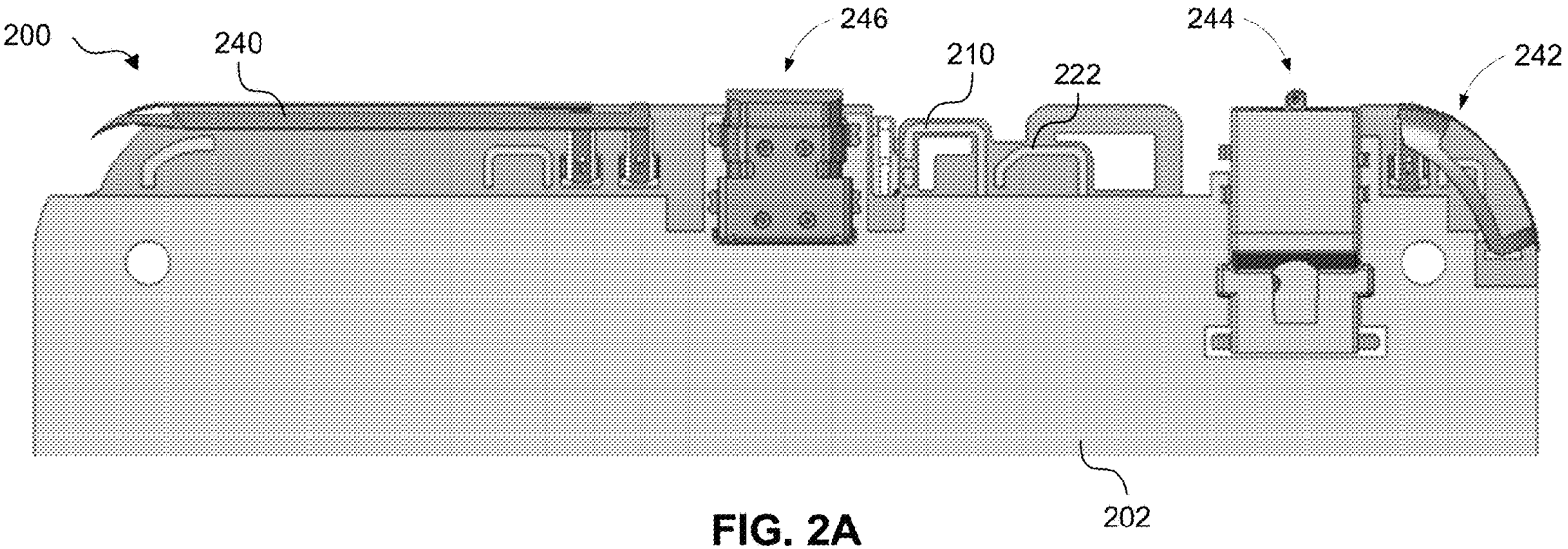
FIG. 2A illustrates a top view of the antenna system according to an exemplary aspect of the present disclosure.
Figure 2B:
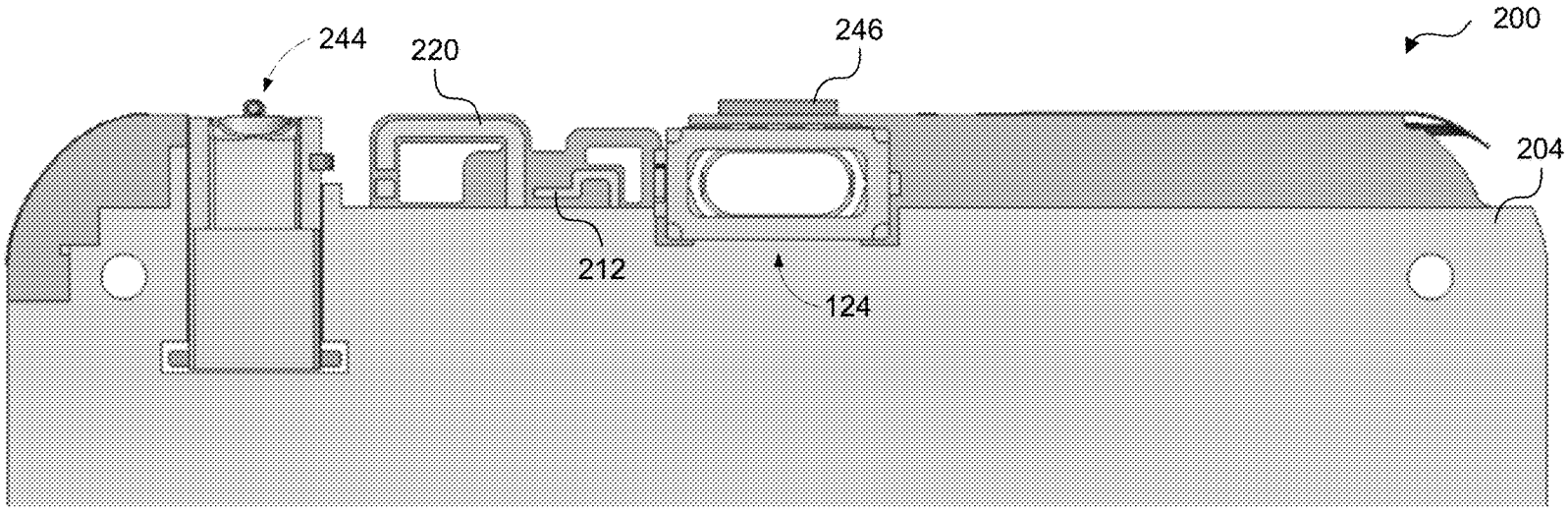
FIG. 2B illustrates a bottom view of the antenna system according to an exemplary aspect of the present disclosure.

The antenna system 100 can be disposed on, for example, a printed circuit board (PCB) 105. The PCB 105 can be formed of, for example, glass reinforced epoxy laminate (e.g., FR-4) or one or more other materials as would be understood by one of ordinary skill in the relevant arts. The PCB 105 can be included in, for example, a communication device that is configured to use the antenna system 100. For the ease of illustrating the various components deposed on the PCB 105, portions of the PCB 105 may have been omitted in the areas of, for example, radiators 110, 120 and electromagnetic couplers 112, 122. These omitted portions are shown in FIGS. 2A and 2B, and is discussed in more detail below. In an exemplary aspect, the radiator 110 and electromagnetic coupler 122 are located on a first (e.g., top) side/surface of the PCB 105 and the radiator 120 and electromagnetic coupler 112 are located on a second (e.g., bottom) side/surface of the PCB 105. As illustrated in FIG. 1A, the electromagnetic coupler 122 can at least partially overlap the radiator 120 and electromagnetic coupler 112 in a direction substantially perpendicular to the first and second surfaces of the PCB 105. Similarly, the radiator 110 can at least partially overlap the electromagnetic coupler 112 in the direction substantially perpendicular to the first and second surfaces of the PCB 105.

In an exemplary aspect, the one or more of the radiators 110, 120 and/or one or more of the electromagnetic couplers 112, 122 can be made of one or more metals, one or more metallic compounds, and/or one or more electrically conductive or semi-conductive materials as would be understood by one of ordinary skill in the relevant arts. The radiators 110, 120 and/or the electromagnetic couplers 112, 122 can include one or more active or passive components (e.g., resistors, inductors, capacitors, etc.) and/or processor circuitry.

In an exemplary aspect, the first radiator 110 and the second radiator 120 can be configured to be tuned independently within a predetermined frequency range to one or more resonances. For example, the first radiator 110 can be a high-band radiator tunable within a frequency range of, for example, 1710 MHz to 2690.

In an exemplary aspect, the frequency range of 1710 MHz to 2690 is split at, for example, 2.2 GHz. In this example, the first radiator 110 can be a high-band radiator tunable within a frequency range of, for example, 2300 MHz to 2690 MHz, but is not limited to this exemplary range. The second radiator 120 can be a mid-band radiator tunable within a frequency range of, for example, 1805 MHz to 2170 MHz, but is not limited to this exemplary range.

Although not illustrated in FIG. 1A (but discussed in detail below), the antenna system 100 can include a third radiator and corresponding electromagnetic coupler, where the third radiator is configured to be tuned independently within a predetermined frequency range to one or more resonances. For example, the third radiator can be a low-band radiator tunable within a frequency range of, for example, 700 MHz to 960 MHz, but is not limited to this exemplary range. In an exemplary aspect, the antenna system 100 can also include at least a fourth radiator configured to be tuned independently within a predetermined frequency range. For example, the fourth radiator can be configured as a broad-band antenna covering a frequency range of, for example 700 MHz to 2690 MHz, as a WLAN antenna, a Global Navigation Satellite System (GNSS) antenna, a Bluetooth antenna, and/or an antenna configured for one or more cellular protocols to provide some examples.

In operation, the first radiator 110 and/or the second radiator 120 can be configured to implement Carrier Aggregation (CA). CA modes can be defined in the transceiver environment, including intra-band contiguous (adjacent) CA, intra-band non-contiguous (non-adjacent) CA, and/or inter-band CA. As discussed above, in intra-band contiguous CA, aggregated component carriers (CCs) are within the same frequency band and adjacent to each other forming a contiguous frequency block. In intra-band non-contiguous CA, aggregated CCs are within the same frequency band but are not adjacent to each other. In inter-band CA, aggregated CCs are in different frequency bands.

Similarly, CA modes can be defined with respect to the antenna environment, including inter antenna aggregation and intra antenna aggregation. For inter antenna aggregation, an antenna can include a single aggregated channel. For example, in exemplary aspects that include low, mid and high band antennas, each of the antennas can be configured for one aggregated channel. This is similar to the CA transceiver environment modes inter-band CA and intra-band CA adjacent.

Figure 3:
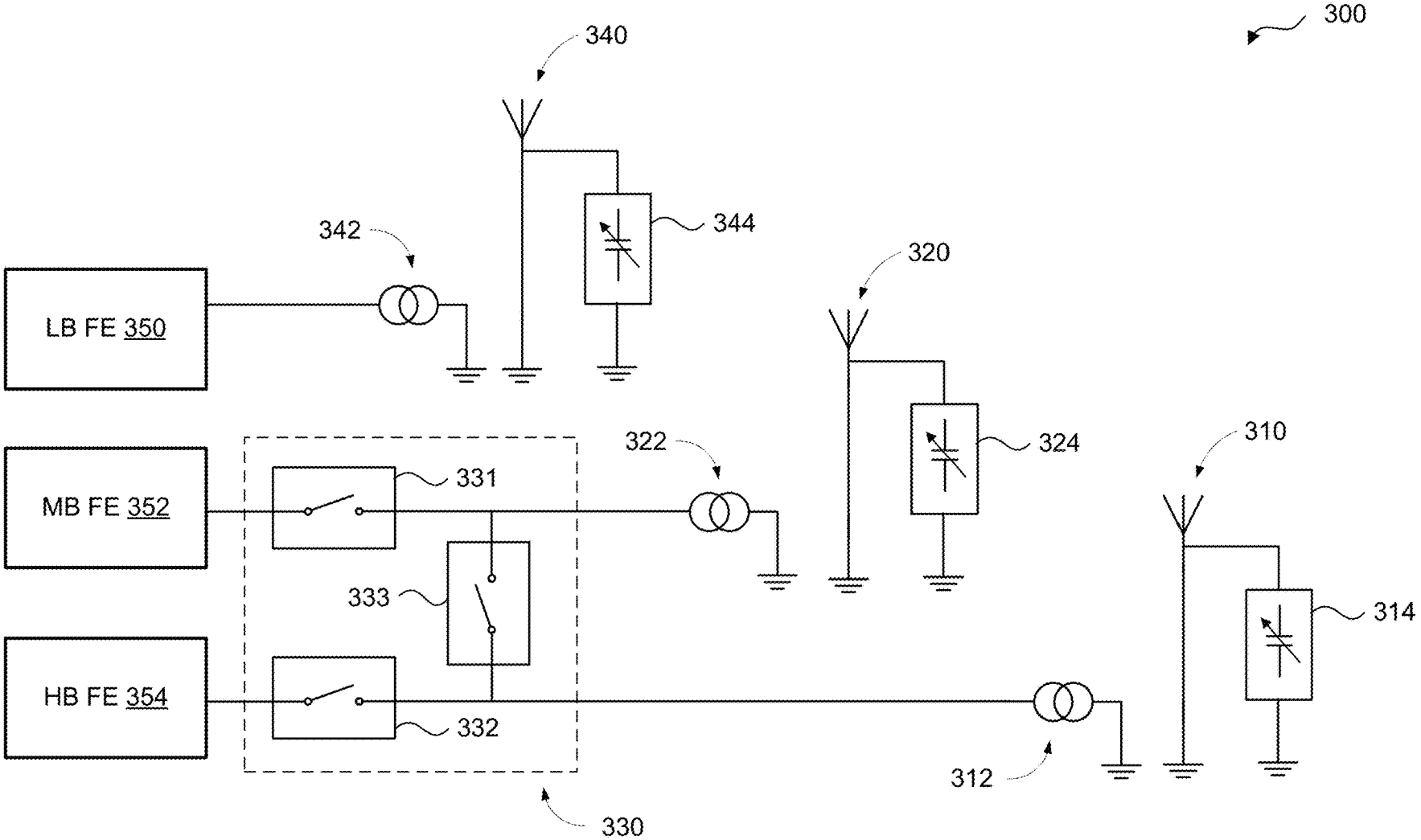
FIG. 3 illustrates a schematic view of an antenna system according to an exemplary aspect of the present disclosure.

In intra antenna aggregation, multiple channels can be aggregated on one antenna. For example, as explained in more detail below, the electromagnetic coupler 112 and the electromagnetic coupler 122 can be coupled (e.g., connected) together and coupled to the same frontend (e.g., mid-band frontend 352 as illustrated in FIG. 3) that is configured to operate on multiple channels (e.g., bands 1 & 3, or bands 2 & 4). In this example, the frontend is coupled to two radiators (e.g., radiators 110 and 120) via the two connected electromagnetic couplers.

Figure 1B:
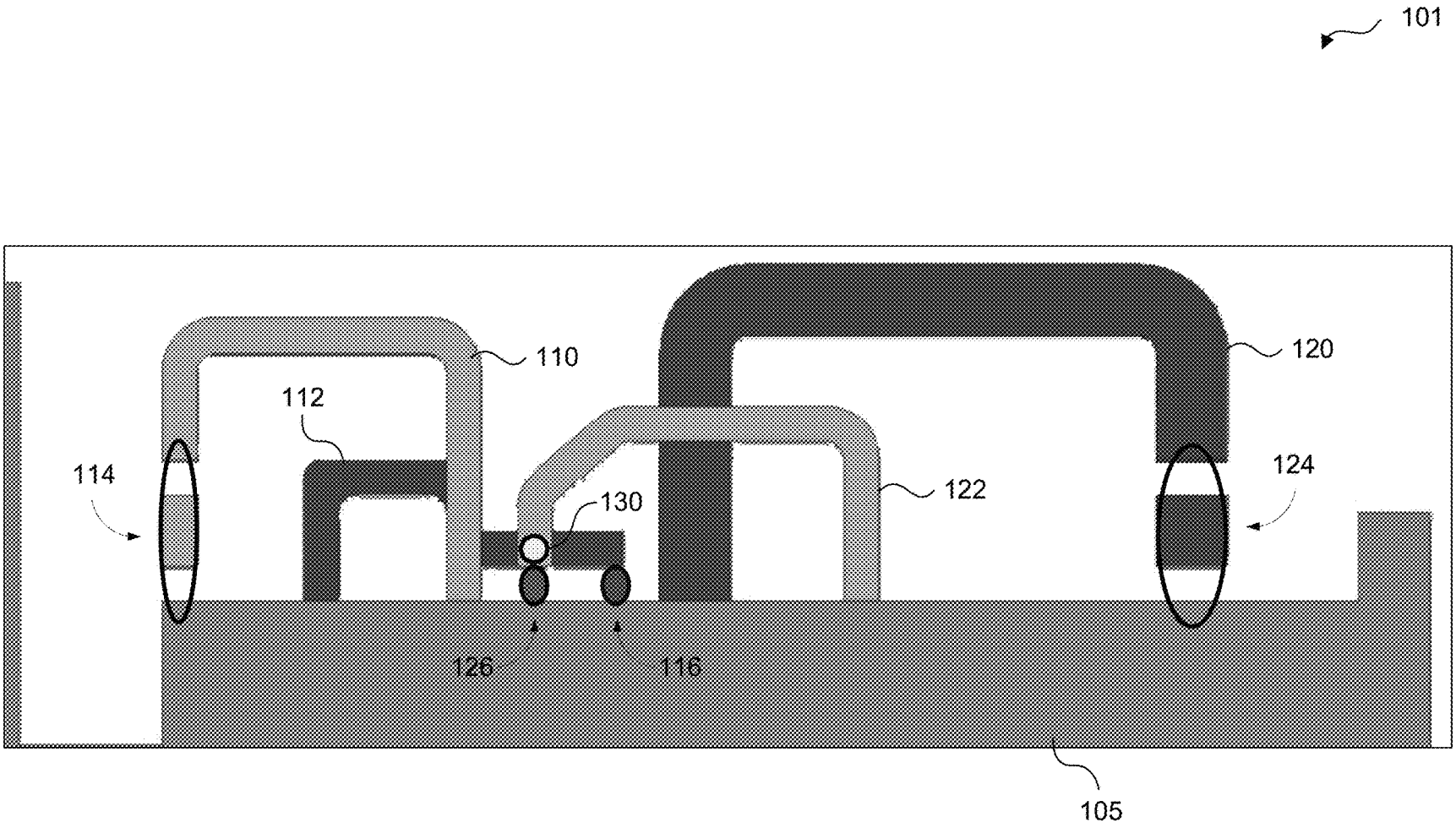
FIG. 1B illustrates a top view of an antenna system according to an exemplary aspect of the present disclosure.

FIG. 1B illustrates a top view of an antenna system 101 according to an exemplary aspect of the present disclosure. The antenna system 101 is similar to the antenna system 100 and includes first and second radiators 110 and 120, and first and second electromagnetic couplers 112 and 122. The antenna system 101 can also include a high-band feed 116, a mid-band feed 126, a high-band tuning device 114, a mid-band tuning device 124, and a switch 130.

The high-band feed 116 can be configured to connect the high-band electromagnetic coupler 112 to a corresponding high-band frontend (e.g., high-band frontend 354). In an exemplary aspect, the high-band feed 116 can include processor circuitry configured to perform the connection. The mid-band feed 126 can be configured to connect the mid-band electromagnetic coupler 122 to a corresponding mid-band frontend (e.g., mid-band frontend 352). In an exemplary aspect, the mid-band feed 126 can include processor circuitry configured to perform the connection.

The high-band tuning device 114 and the mid-band tuning device 124 can each include processor circuitry that is configured to tune the high-band radiator 110 and the mid-band radiator 120, respectively. In an exemplary aspect, the high-band tuning device 114 and/or the mid-band tuning device 124 can include one or more tunable capacitors (e.g., tunable capacitors 314, 324).

The switch 130 can be configured to couple the high-band electromagnetic coupler 112 and the mid-band electromagnetic coupler 122 together. The switch 130 can also be configured to connect the high-band electromagnetic coupler 112 and the mid-band electromagnetic coupler 122 to the high-band feed 116 or the mid-band feed 126. In an exemplary aspect, the switch 130 can be configured to couple the high-band electromagnetic coupler 112 and the mid-band electromagnetic coupler 122 together, and to couple the connected couplers 112 and 122 to the high-band feed 116 or the mid-band feed 126. In this example, the other one of the feeds is decoupled from the connected couplers 112 and 122. The switch 130 can include one or more mechanical and/or electrical (e.g., semiconductor device) switches, and/or processor circuitry that are configured to perform one or more of the various connections described herein. The operation of the switch 130 is illustrated in more detail with reference to FIG. 3 discussed below. In an exemplary aspect, one or more internal and/or external controllers, processor circuitry, and/or one or a device (e.g., a mobile device) in which the antenna system has been implemented can be configured to control the operation of the switch 130.

FIGS. 2A-2B illustrate an antenna system 200 according to an exemplary aspect of the present disclosure. FIG. 2A illustrates a top view of the antenna system 200 and FIG. 2B illustrates a bottom view of the antenna system 200. The antenna system 200 includes a high-band electromagnetic coupler 212, a high-band radiator 210, a mid-band electromagnetic coupler 222, and a mid-band radiator 220. The high-band electromagnetic coupler 212, a high-band radiator 210, a mid-band electromagnetic coupler 222, and a mid-band radiator 220 can be exemplary aspects of the high-band electromagnetic coupler 112, a high-band radiator 110, a mid-band electromagnetic coupler 122, and a mid-band radiator 120, respectively, of the antenna systems 100, 101. The antenna system 200 can also include one or more other antennas (radiators and corresponding couplers), including, for example antenna 240 and antenna 242. Antenna 240 can be an antenna configured to support, for example, WLAN frequency ranges and/or low-band frequency ranges (e.g., 700 MHz to 960 MHz). Antenna 242 can be configured to support, for example, WLAN and/or GNSS frequencies. The antenna system 200 can also include one or more input/output ports, such as audio jack 244 and High-Definition Multimedia Interface (HDMI) port 246. The HDMI port 246 can be mounted on, for example, a top surface 202 of the PCB. A speaker 248 can also be mounted on the bottom side 204 of the PCB.

FIG. 3 illustrates a schematic view of an antenna system 300 according to an exemplary aspect of the present disclosure. The antenna system 300 can be an exemplary aspect of the antenna systems 100, 101, and 200.

The antenna system 300 can include high-band radiator 310 and corresponding high-band electromagnetic coupler 312 and tuning device 314, mid-band radiator 320 and corresponding mid-band electromagnetic coupler 322 and tuning device 324, low-band radiator 340 and corresponding low-band electromagnetic coupler 342 and tuning device 344, switch 330, low-band frontend 350, mid-band frontend 352, and high-band frontend 354. These components are similar to the corresponding components discussed above with respect to antenna systems 100, 101, and 200, and discussion of similar features and/or functions of these components have been omitted for brevity.

In an exemplary aspect, the low-band radiator 340 can be tunable within a frequency range of, for example, 700 MHz to 960 MHz, the mid-band radiator 320 can be tunable within a frequency range of, for example, 1805 MHz to 2170 MHz, and the high-band radiator 310 can be tunable within a frequency range of, for example, 2300 MHz to 2690 MHz. The frequency ranges are not limited to these exemplary frequency ranges as would be understood by those skilled in the relevant arts.

The switch 330 can include switches 331, 332, and 333 that are configured to couple/connect one or more frontends to one or more electromagnetic couplers. The switch 330 can be configured to control the aggregation modes of the antenna system 300, including configuring the system to operate in an inter antenna aggregation mode or and intra antenna aggregation mode. In an exemplary aspect, one or more internal and/or external controllers, processor circuitry, and/or one or a device (e.g., a mobile device) in which the antenna system has been implemented can be configured to control the operation of the switch 330. For example, switch 331 can be configured to connect/disconnect the mid-band frontend 352 to/from the mid-band electromagnetic coupler 322 and/or connect/disconnect the mid-band frontend 352 to/from the high-band electromagnetic coupler 312 via switch 333. The switch 332 can be configured to connect/disconnect the high-band frontend 354 to/from the high-band electromagnetic coupler 312, and/or connect/disconnect the high-band frontend 354 to/from the mid-band electromagnetic coupler 322 via switch 333. That is, the switch 333 can be configured to connect/disconnect the mid-band frontend 352 to/from the high-band electromagnetic coupler 312, and to connect/disconnect the high-band frontend 354 to/from the mid-band electromagnetic coupler 322. In intra antenna aggregation configurations, the switches 331-333 are configured such that only one of the mid-band and high-band frontends 352, 354 is connected to the mid-band and high-band electromagnetic couplers 322, 312. Example configurations are shown below in Table 1, where "1" represents the switch is closed, and "0" represents the switch is open. S1, S2, and S3 represent different tunable states of the tuning devices 314, 324, 344.

TABLE 1

| Aggregation and Switch Configuration | | | | | | |
|---|---|---|---|---|---|---|
| | Tuning | | | Switches | | |
| | LB | MB | HB | | | |
| Mode | 344 | 324 | 314 | 331 | 332 | 333 |
| LB | S1 | — | — | — | — | — |
| MB Inter Ant. Aggregation | — | S1 | — | 1 | 0 | 0 |
| HB Inter Ant. Aggregation | — | — | S1 | 0 | 1 | 0 |
| MB Intra Ant. Aggregation | — | S2 | S2 | 1 | 0 | 1 |
| HB Intra Ant. Aggregation | — | S3 | S3 | 0 | 1 | 1 |

With reference to Table 1, in a mid-band intra antenna aggregation mode, switches 331 and 333 will be closed, while switch 332 will be open. In this configuration, the high-band frontend 354 will be disconnected from the high-band electromagnetic coupler 312, and the mid-band frontend 352 will be connected to the high-band electromagnetic coupler 312 via switches 331 and 333, and to the mid-band electromagnetic coupler 322 via switch 331.

Similarly, in a high-band intra antenna aggregation mode, switches 332 and 333 will be closed, while switch 331 will be open. In this configuration, the mid-band frontend 352 will be disconnected from the mid-band electromagnetic coupler 322, and the high-band frontend 354 will be connected to the high-band electromagnetic coupler 312 via switch 332, and to the mid-band electromagnetic coupler 322 via switches 332 and 333.

FIGS. 4A-4D illustrate various view of an antenna system 400 according to an exemplary aspect of the present disclosure. The antenna system 400 is similar to the antenna systems 100, 101, 200 and/or 300, but the high-band and mid-band coupler/radiator pairs of the antenna system 400 have been separated laterally along the PCB 405.

Figure 4A:
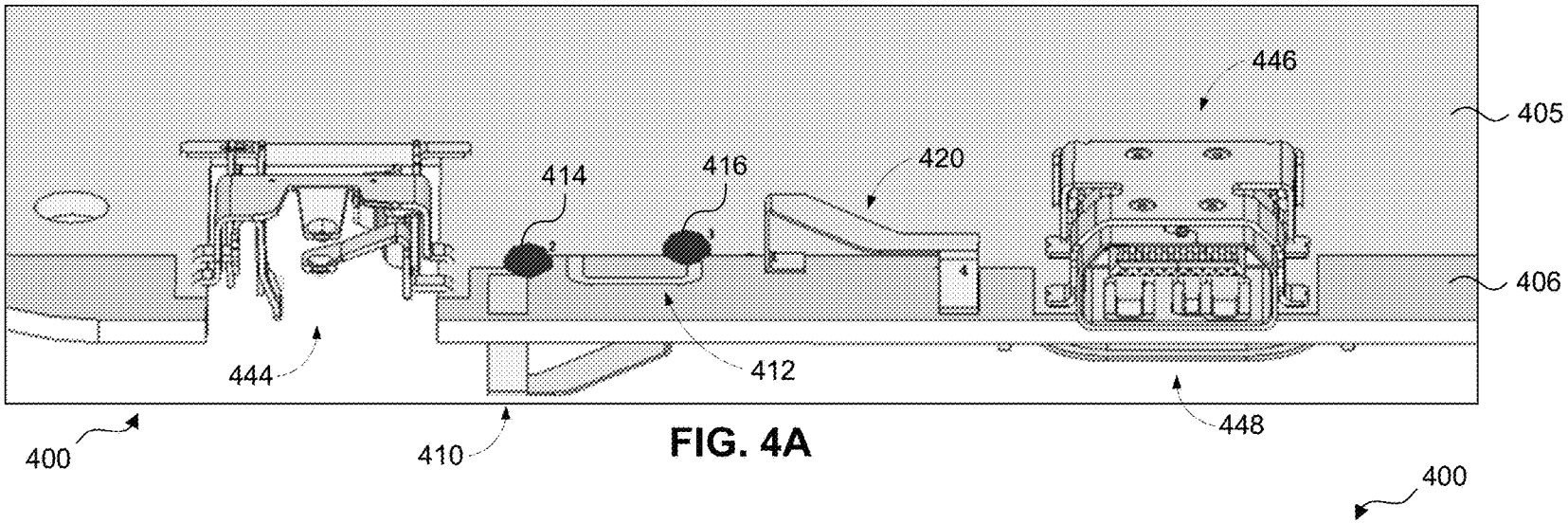
FIG. 4A illustrates a top front perspective view of antenna system according to an exemplary aspect of the present disclosure.
Figure 4B:
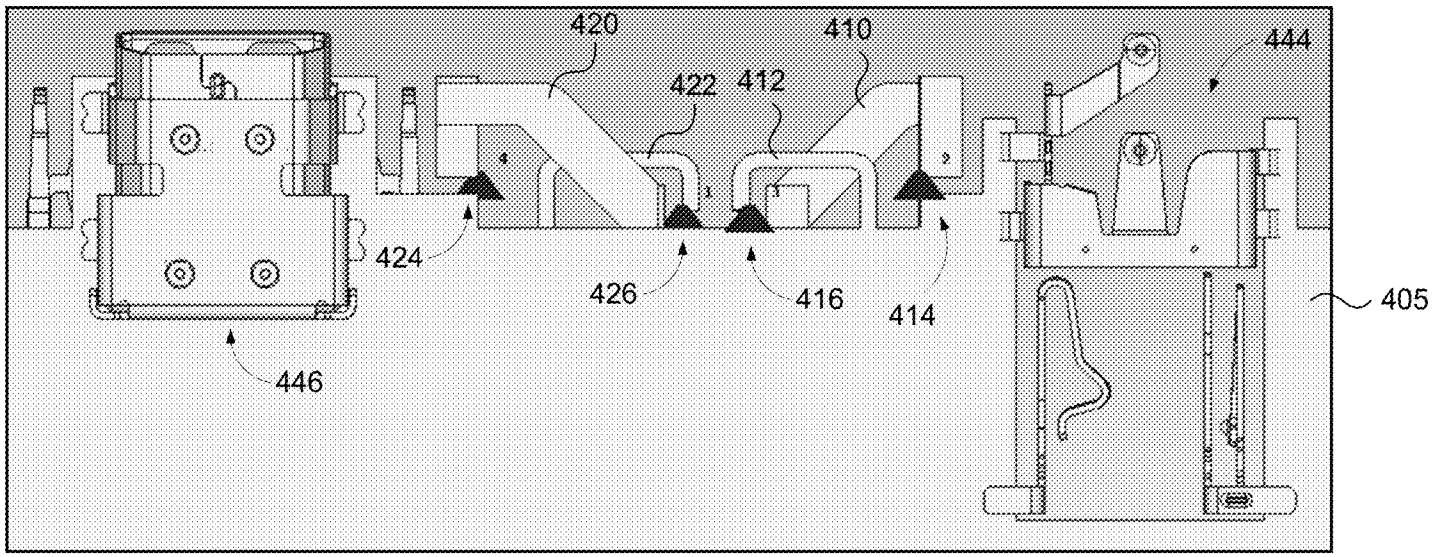
FIG. 4B illustrates a top view of antenna system according to an exemplary aspect of the present disclosure.
Figure 4C:
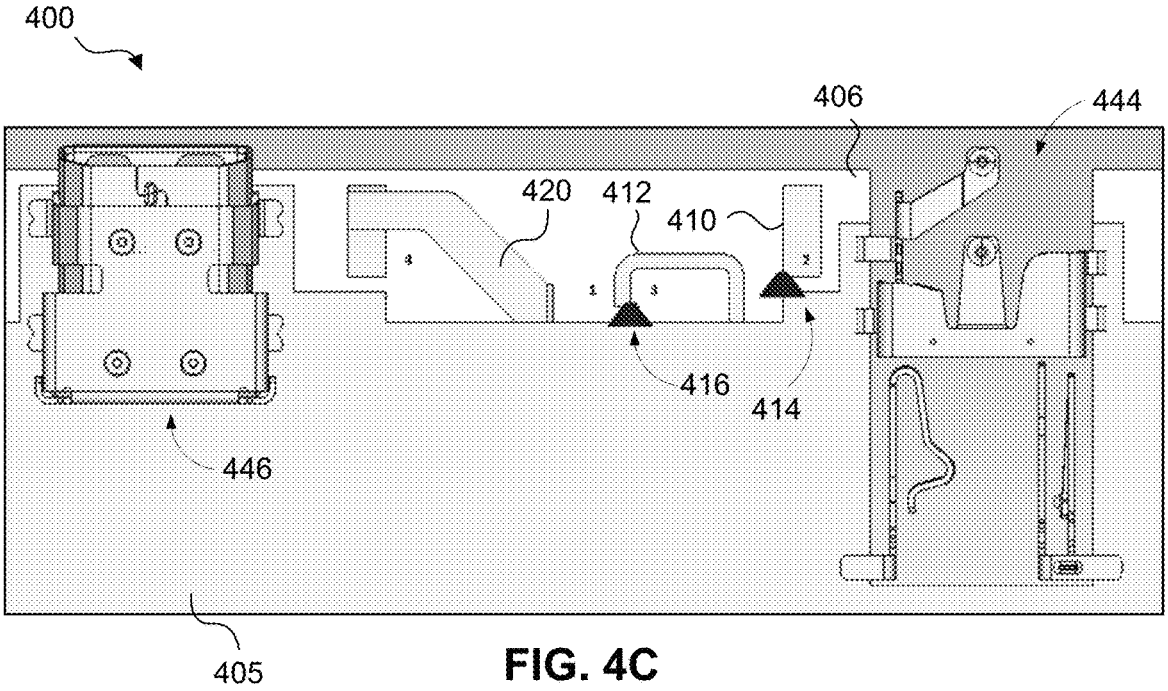
FIG. 4C illustrates a top view of antenna system according to an exemplary aspect of the present disclosure.
Figure 4D:
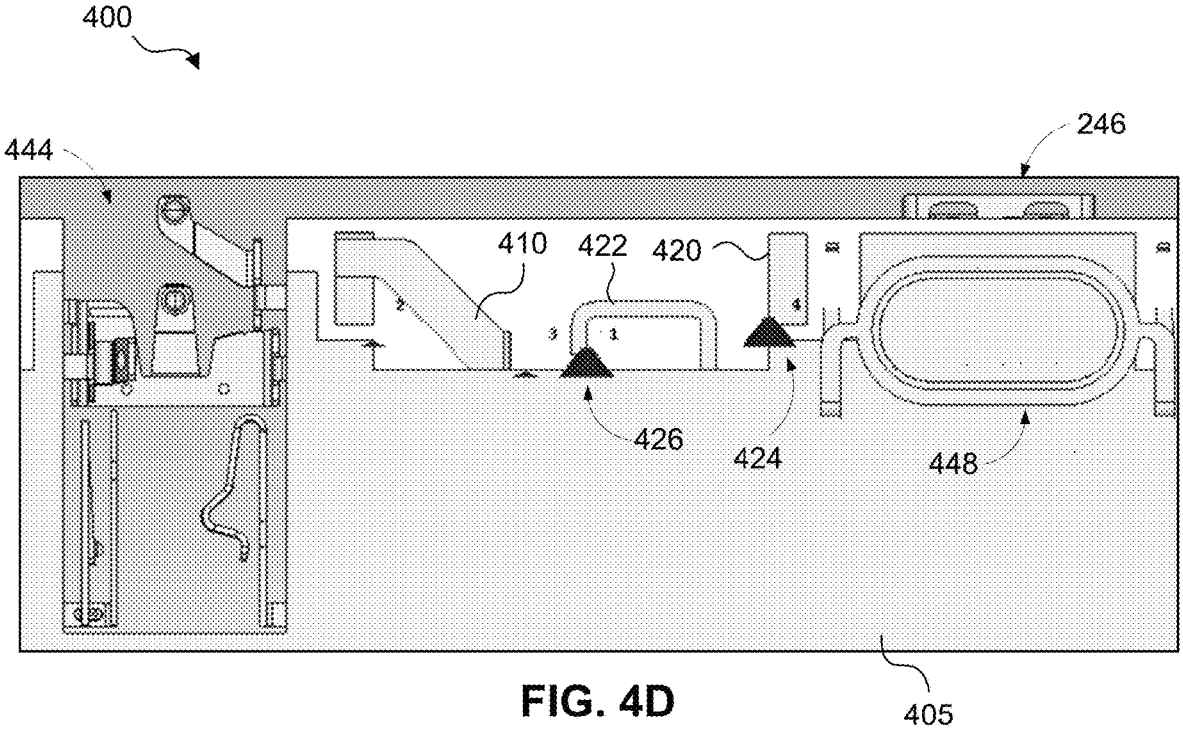
FIG. 4D illustrates a bottom view of antenna system according to an exemplary aspect of the present disclosure.

FIG. 4A is a top front perspective view of antenna system 400. FIG. 4B is a top view of antenna system 400 with a portion 406 of the PCB 405 having been omitted. FIG. 4C is a top view of antenna system 400 in which the portion 406 of the PCB 405 has been included. FIG. 4D is a bottom view of antenna system 400 in which the portion 406 of the PCB 405 has been included.

The antenna system 400 includes a high-band electromagnetic coupler 412, a high-band radiator 410, a mid-band electromagnetic coupler 422, and a mid-band radiator 420. The high-band electromagnetic coupler 412, the high-band radiator 410, the mid-band electromagnetic coupler 422, and the mid-band radiator 420 can be exemplary aspects of the high-band electromagnetic coupler 112, high-band radiator 110, mid-band electromagnetic coupler 122, and mid-band radiator 120, respectively, of the antenna systems 100, 101. The antenna system 400 can also include one or more input/output ports, such as audio jack 444 and High-Definition Multimedia Interface (HDMI) port 446. The HDMI port 446 can be mounted on, for example, a top surface of the PCB 405. A speaker 448 can also be mounted on the bottom side of the PCB 405.

The antenna system 400 can also include a high-band feed 416, a mid-band feed 426, a high-band tuning device 414, and a mid-band tuning device 424. The high-band feed 416 can be configured to connect the high-band electromagnetic coupler 412 to a corresponding high-band frontend (e.g., high-band frontend 454 illustrated in FIG. 4E). In an exemplary aspect, the high-band feed 416 can include processor circuitry configured to perform the connection. The mid-band feed 426 can be configured to connect the mid-band electromagnetic coupler 422 to a corresponding mid-band frontend (e.g., mid-band frontend 452 illustrated in FIG. 4E). In an exemplary aspect, the mid-band feed 416 can include processor circuitry configured to perform the connection.

The high-band tuning device 414 and the mid-band tuning device 424 can each include processor circuitry that is configured to tune the high-band radiator 410 and the mid-band radiator 420, respectively. In an exemplary aspect, the high-band tuning device 414 and/or the mid-band tuning device 424 can include one or more tunable capacitors.

In an exemplary aspect, the mid-band radiator 420 and the high-band electromagnetic coupler 412 are located on a first (e.g., top) side/surface of the PCB 405 and the high-band radiator 410 and the mid-band electromagnetic coupler 422 are located on a second (e.g., bottom) side/surface of the PCB 105.

As illustrated in FIG. 4B, the mid-band radiator 420 can at least partially overlap the mid-band electromagnetic coupler 422 in a direction substantially perpendicular to the first and second surfaces of the PCB 405. Similarly, the high-band radiator 410 can at least partially overlap the high-band electromagnetic coupler 412 in the direction substantially perpendicular to the first and second surfaces of the PCB 405. In an exemplary aspect, the mid-band radiator 420 can completely overlap the mid-band electromagnetic coupler 422. That is, the mid-band radiator 420 can be within the mid-band electromagnetic coupler 422. Similarly, the high-band radiator 410 can completely overlap the high-band electromagnetic coupler 412. That is, the high-band electromagnetic coupler 412 can be within the high-band radiator 410.

Further, the mid-band radiator 420 and/or the mid-band electromagnetic coupler 422 can be spaced apart from the high-band radiator 410 and/or the high-band electromagnetic coupler 412 in a direction substantially parallel to the first and/or the second surfaces of the PCB 405. That is, the mid-band electromagnetic coupler 422 can be spaced apart from (and not overlap) the high-band electromagnetic coupler 412. This is different from the exemplary aspect illustrated in FIGS. 1A and 1B where the couplers 112 and 122 at least partially overlap.

As illustrated in FIG. 4B, the mid-band electromagnetic coupler 422 and the high-band electromagnetic coupler 412 are on opposite sides of the PCB 405. Similarly, the high-band radiator 410 and the mid-band radiator 420 are on opposite sides of the PCB 405, where the high-band radiator 410 is on the same side as the mid-band electromagnetic coupler 422 and the mid-band radiator 420 is on the same side as the high-band electromagnetic coupler 412. However, the various radiators and couplers are not limited to this configuration, and the various radiators and couplers can be positioned on the PCB in any configuration as would be understood by one of ordinary skill in the relevant arts. For example, both couplers 412 and 422 can be on same side, both radiators 410 and 420 can be on the same side, radiators 410 and 420 can be on opposite sides while the couplers 412 and 422 are on the same side, couplers 412 and 422 can be on opposite sides while the radiators 410 and 420 are on opposite sides, or the couplers 412 and 422 and the radiators 410 and 420 can all be on the same side of the PCB 405.

Figure 4E:
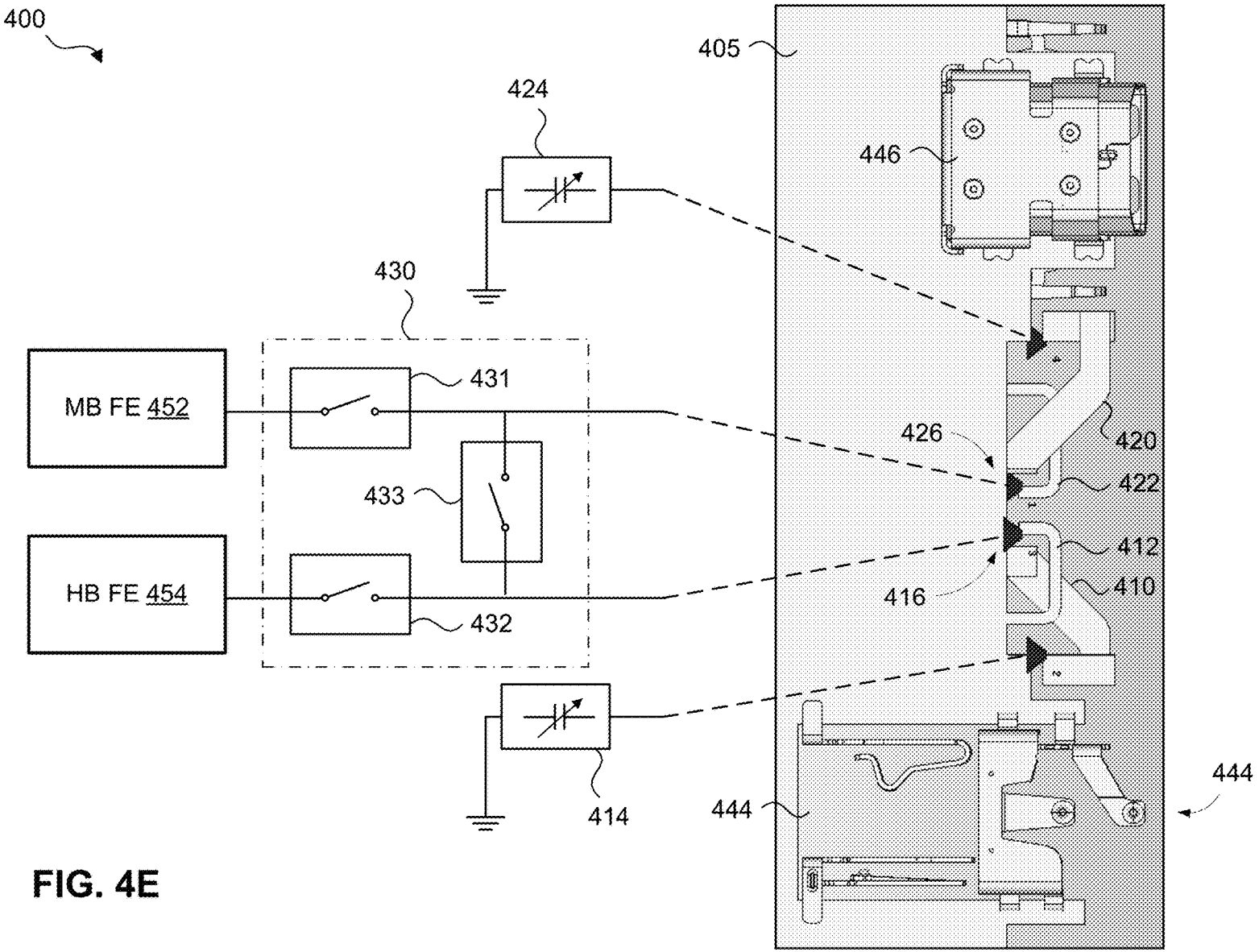
FIG. 4E illustrates a combined top view and schematic view of the antenna system according to an exemplary aspect of the present disclosure.

FIG. 4E illustrates a combined top view and schematic view of the antenna system 400. The top view is similar to the top view illustrated in FIG. 4B in which the portion 406 of the PCB 405 has been omitted.

As illustrated in FIG. 4E, the system 400 can include a switch 430 that is configured to couple the high-band electromagnetic coupler 412 and the mid-band electromagnetic coupler 422 together. The switch 430 can also be configured to connect the high-band electromagnetic coupler 412 and the mid-band electromagnetic coupler 422 to mid-band frontend 452 or the high-band frontend 454. In an exemplary aspect, the switch 430 can be configured to couple the high-band electromagnetic coupler 412 and the mid-band electromagnetic coupler 422 together, and to couple the connected couplers 412 and 422 to the mid-band frontend 452 or the high-band frontend 454. In this example, the other one of the frontends is decoupled from the connected couplers 412 and 422. The switch 430 can include one or more mechanical and/or electrical (e.g., semiconductor device) switches, and/or processor circuitry that are configured to perform one or more of the various connections described herein.

The switch 430 can be an exemplary aspect of the switch 330. The switch 430 can include switches 431, 432, and 433 that are configured to couple/connect one or more frontends to one or more electromagnetic couplers. The switch 430 can be configured to control the aggregation modes of the antenna system 400, including configuring the system to operate in an inter antenna aggregation mode or and intra antenna aggregation mode. In an exemplary aspect, one or more internal and/or external controllers, processor circuitry, and/or one or a device (e.g., a mobile device) in which the antenna system has been implemented can be configured to control the operation of the switch 430.

For example, switch 431 can be configured to connect/disconnect the mid-band frontend 452 to/from the mid-band electromagnetic coupler 422 and/or connect/disconnect the mid-band frontend 452 to/from the high-band electromagnetic coupler 412 via switch 433. The switch 432 can be configured to connect/disconnect the high-band frontend 454 to/from the high-band electromagnetic coupler 412 and/or connect/disconnect the high-band frontend 454 to/from the mid-band electromagnetic coupler 422. That is, the switch 433 can be configured to connect/disconnect the mid-band frontend 452 to/from the high-band electromagnetic coupler 412, and to connect/disconnect the high-band frontend 454 to/from the mid-band electromagnetic coupler 422. In intra antenna aggregation configurations, the switches 431-433 are configured such that only one of the mid-band and high-band frontends 452, 454 is connected to the mid-band and high-band electromagnetic couplers 320, 310. Example configurations are shown below in Table 2, where "1" represents the switch is closed, and "0" represents the switch is open. S1, S2, and S3 represent different tunable states of the tuning devices 214, 224, 244. The configurations illustrated in Table 2 are similar to the configurations illustrated in Table 1.

TABLE 2

| Aggregation and Switch Configuration | | | | | |
|---|---|---|---|---|---|
| | Tuning | | | | |
| | MB | HB | Switches | | |
| Mode | 424 | 414 | 431 | 432 | 433 |
| MB Inter Ant. Aggregation | S1 | — | 1 | 0 | 0 |
| HB Inter Ant. Aggregation | — | S1 | 0 | 1 | 0 |
| MB Intra Ant. Aggregation | S2 | S2 | 1 | 0 | 1 |
| HB Intra Ant. Aggregation | S3 | S3 | 0 | 1 | 1 |

With reference to Table 2, in a mid-band intra antenna aggregation mode, switches 431 and 433 will be closed, while switch 432 will be open. In this configuration, the high-band frontend 454 will be disconnected from the high-band electromagnetic coupler 412, and the mid-band frontend 452 will be connected to the high-band electromagnetic coupler 412 via switches 431 and 433, and to the mid-band electromagnetic coupler 422 via switch 431.

Similarly, in a high-band intra antenna aggregation mode, switches 432 and 433 will be closed, while switch 431 will be open. In this configuration, the mid-band frontend 452 will be disconnected from the mid-band electromagnetic coupler 422, and the high-band frontend 454 will be connected to the high-band electromagnetic coupler 412 via switch 432, and to the mid-band electromagnetic coupler 422 via switches 432 and 433.

Figure 5A:
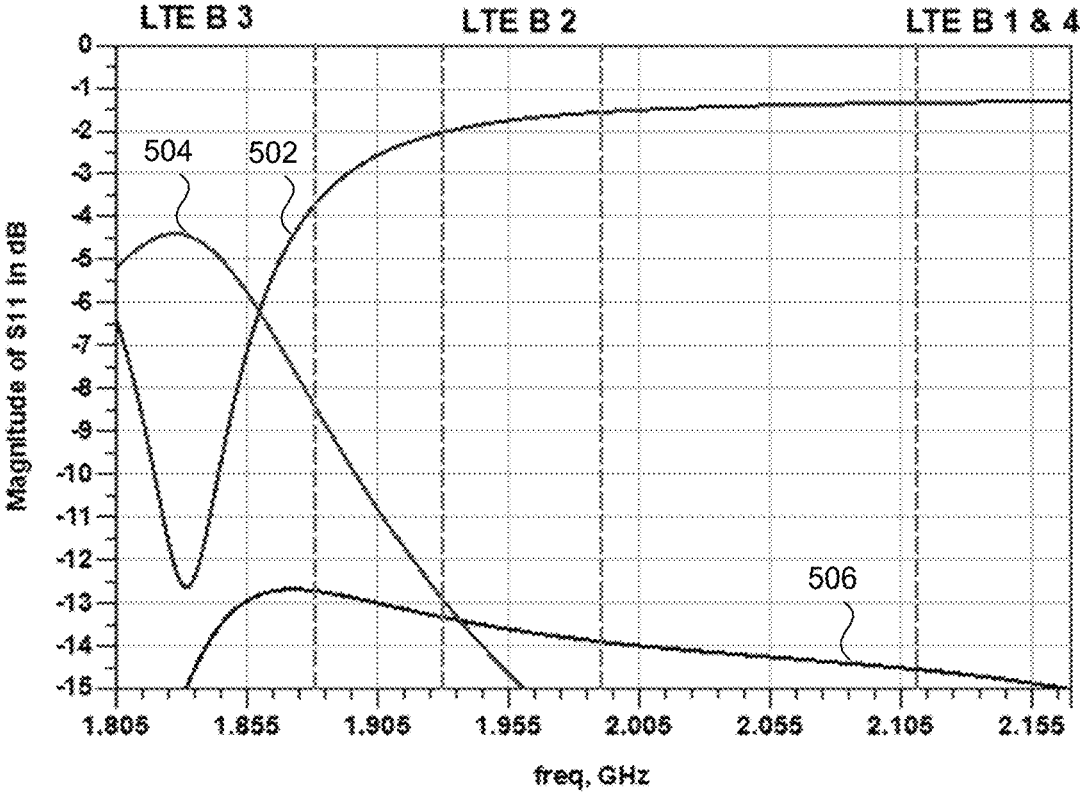
FIGS. 5A and 5B illustrate an impedance plot of an antenna system according to an exemplary aspect of the present disclosure.
Figure 5B:
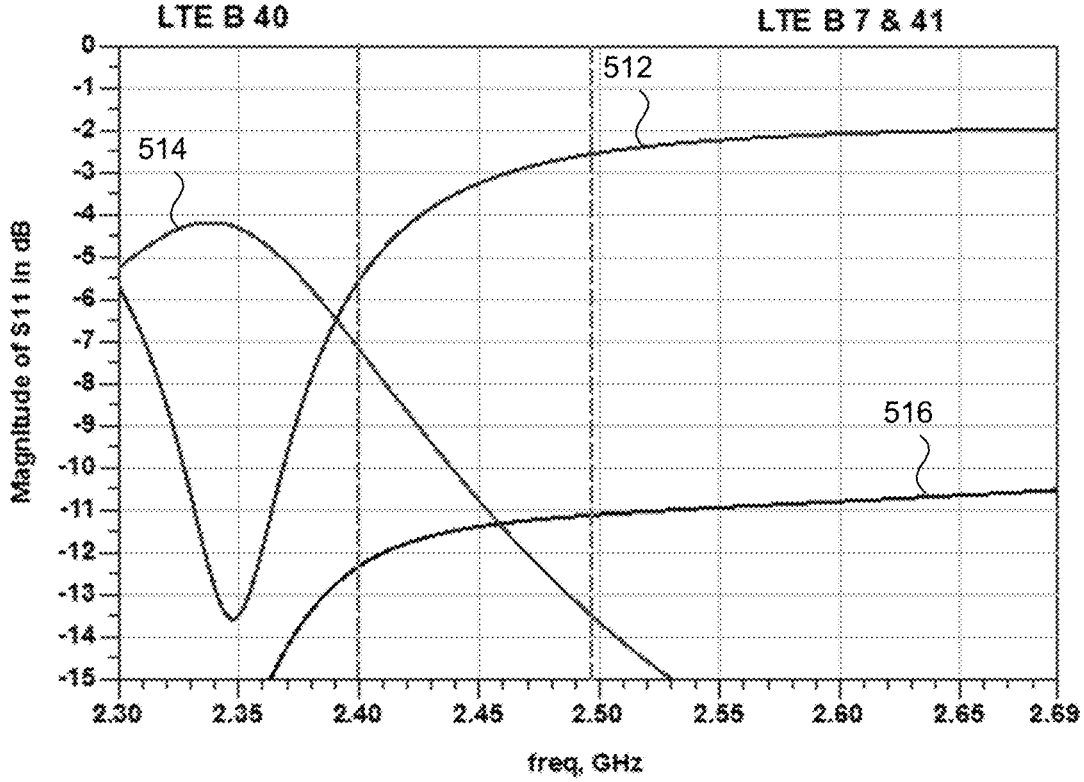

FIGS. 5A and 5B illustrate an impedance plot of an antenna system having a dual coupled, dual element (DCDE) configuration according to an exemplary aspect. The illustrated impedance plot can be an example response for one or more of the exemplary antenna systems described herein. FIG. 5A illustrates a response associated with a mid-band antenna at a lower end of an exemplary frequency range while FIG. 5B illustrates a response associated with a high-band antenna at a lower end of an exemplary frequency range of the high-band antenna.

Plots 502 and 512 correspond to the impedance responses of a mid-band antenna and a high-band antenna, respectively. Plots 504 and 514 correspond to the radiated efficiency of the mid-band antenna and the high-band antenna, respectively. Plots 506 and 516 correspond to the isolation between the mid-band and high-band antennas. In this example, the isolation plot 506 is with respect to the mid-band antenna and the isolation plot 516 is with respect to the high-band antenna.

Figure 6A:
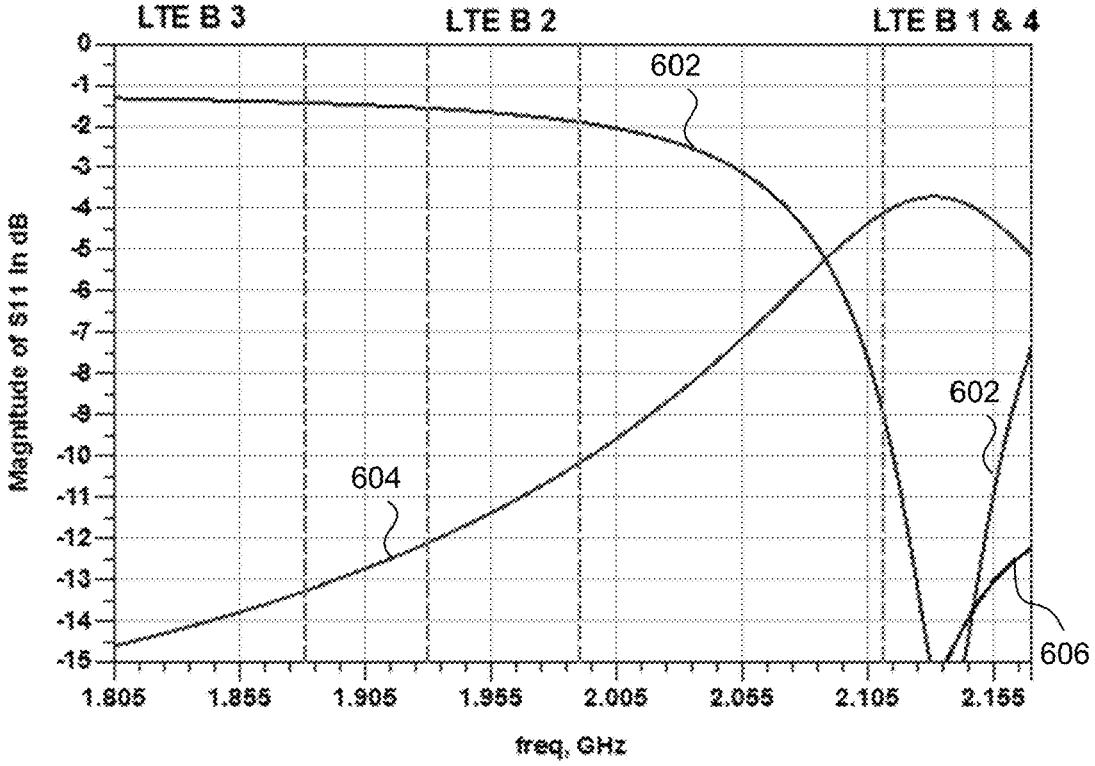
FIGS. 6A and 6B illustrate an impedance plot of an antenna system according to an exemplary aspect of the present disclosure.
Figure 6B:
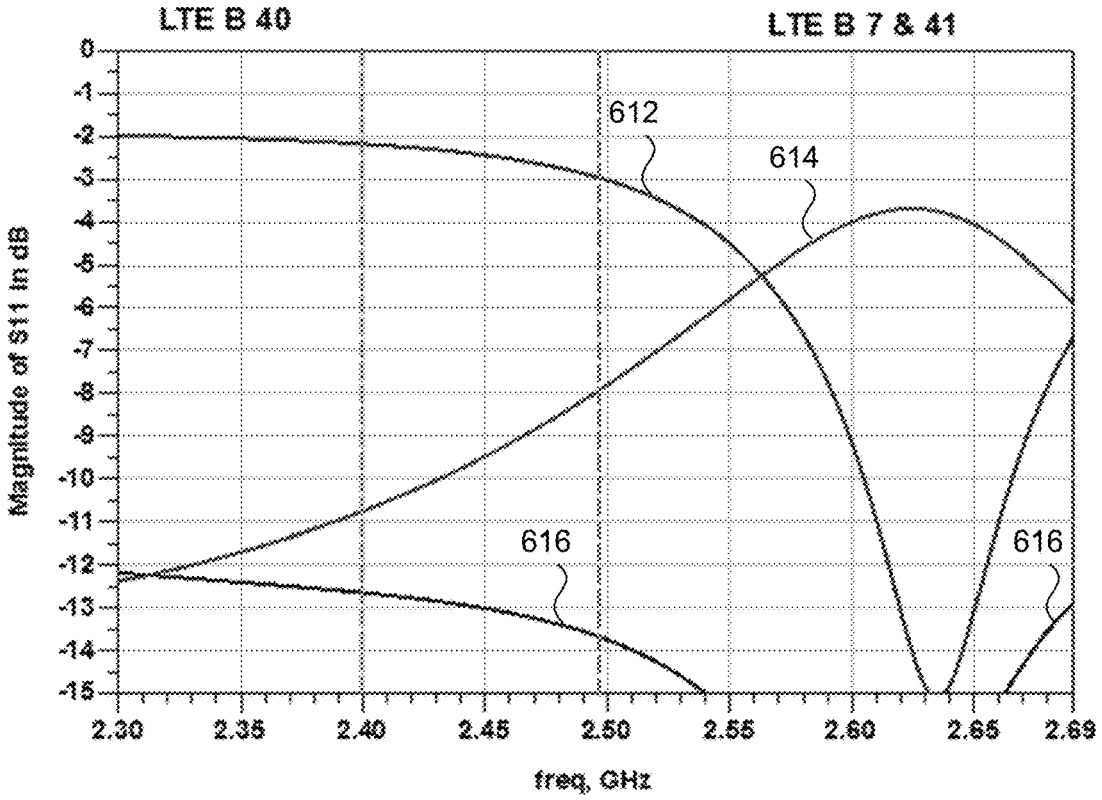

FIGS. 6A and 6B illustrate an impedance plot of an antenna system having a DCDE configuration according to an exemplary aspect. The illustrated impedance plot can be example responses for one or more of the exemplary antenna systems described herein. FIG. 6A illustrates a response associate with the mid-band antenna at a higher end of the exemplary frequency range while FIG. 6B illustrates a response associated with the high-band antenna at a higher end of the exemplary frequency range of the high-band antenna.

Plots 602 and 612 correspond to the impedance responses of a mid-band antenna and a high-band antenna, respectively. Plots 604 and 614 correspond to the radiated efficiency of the mid-band antenna and the high-band antenna, respectively. Plots 606 and 616 correspond to the isolation between the mid-band and high-band antennas. In this example, the isolation plot 606 is with respect to the mid-band antenna and the isolation plot 616 is with respect to the high-band antenna.

Figure 7A:
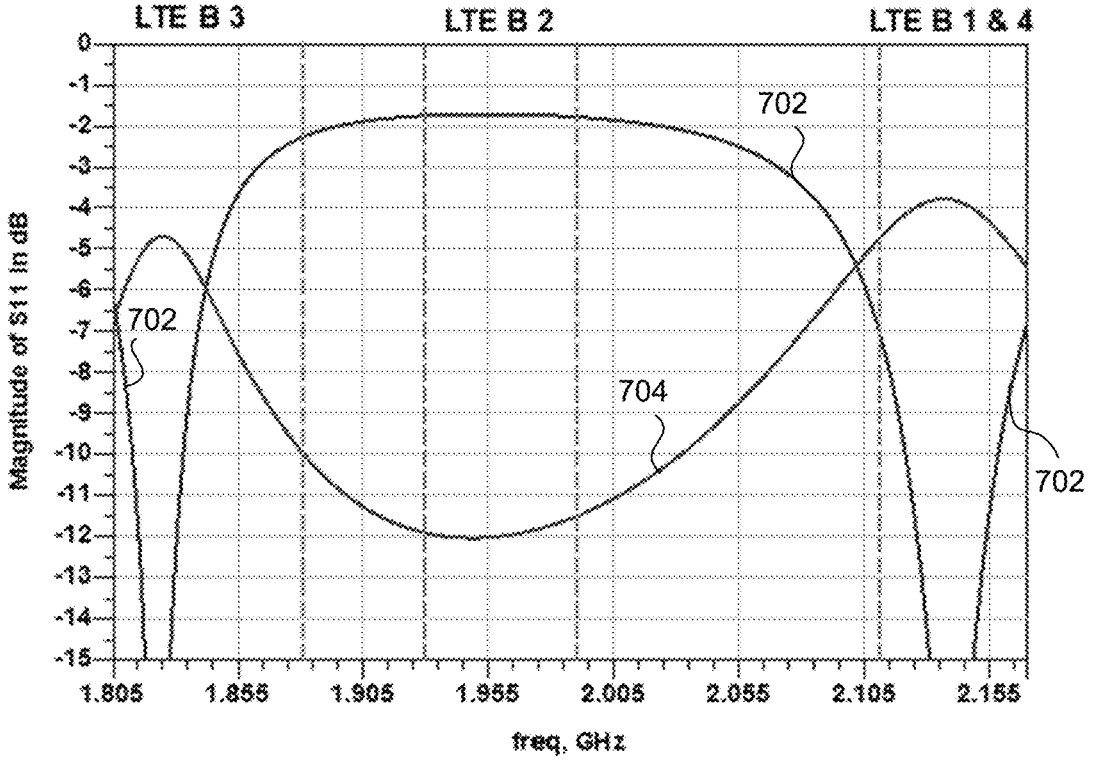
FIGS. 7A and 7B illustrate an impedance plot of an antenna system according to an exemplary aspect of the present disclosure.
Figure 7B:
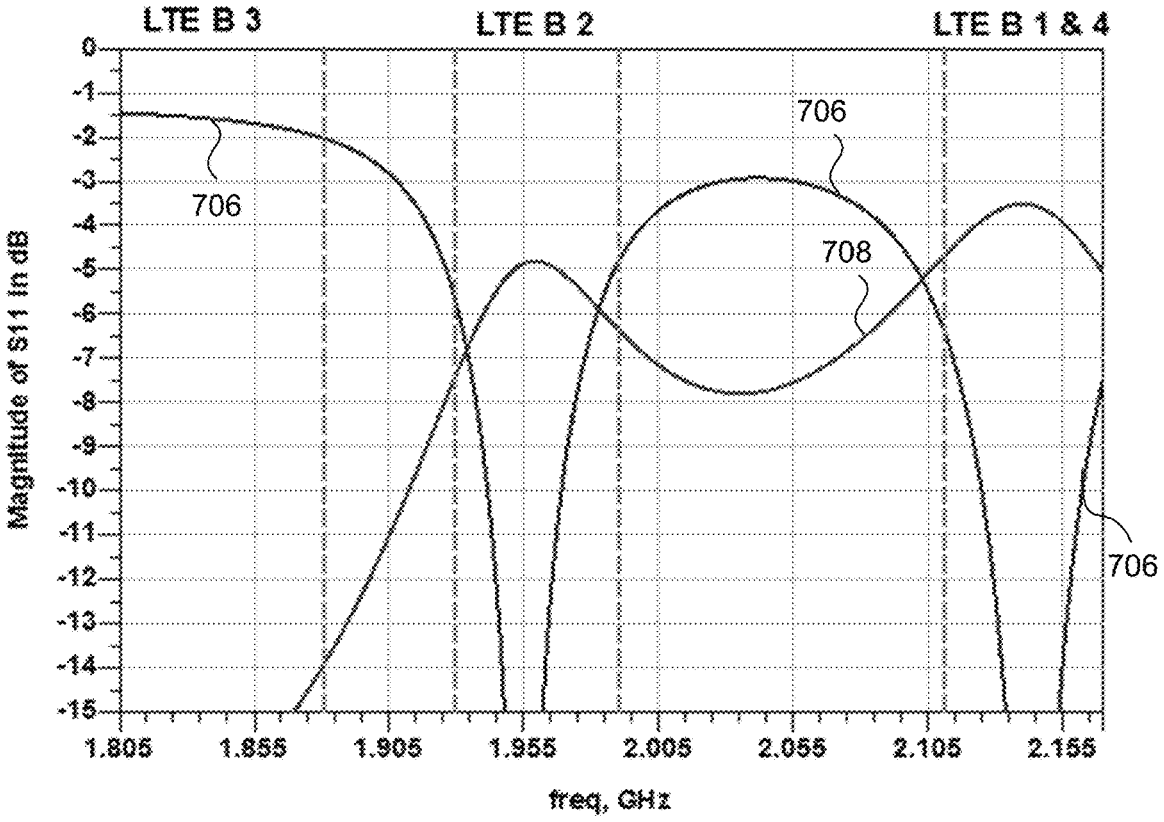

FIGS. 7A and 7B illustrate an impedance plot of an antenna system according to an exemplary aspect. The illustrated impedances can be example responses for one or more of the exemplary antenna systems described herein.

The antenna system includes a DCDE arrangement that is configured for a single feed operation (i.e., intra antenna aggregation mode) of two channels in the mid-band. For example, FIG. 7A illustrates the aggregation of, for example, LTE bands 1 and 3 and FIG. 7B illustrates the aggregation of, for example, LTE bands 2 and 4. Plots 702 and 706 correspond to the impedance responses and plots 704 and 708 correspond to the radiated efficiencies.

Figure 8:
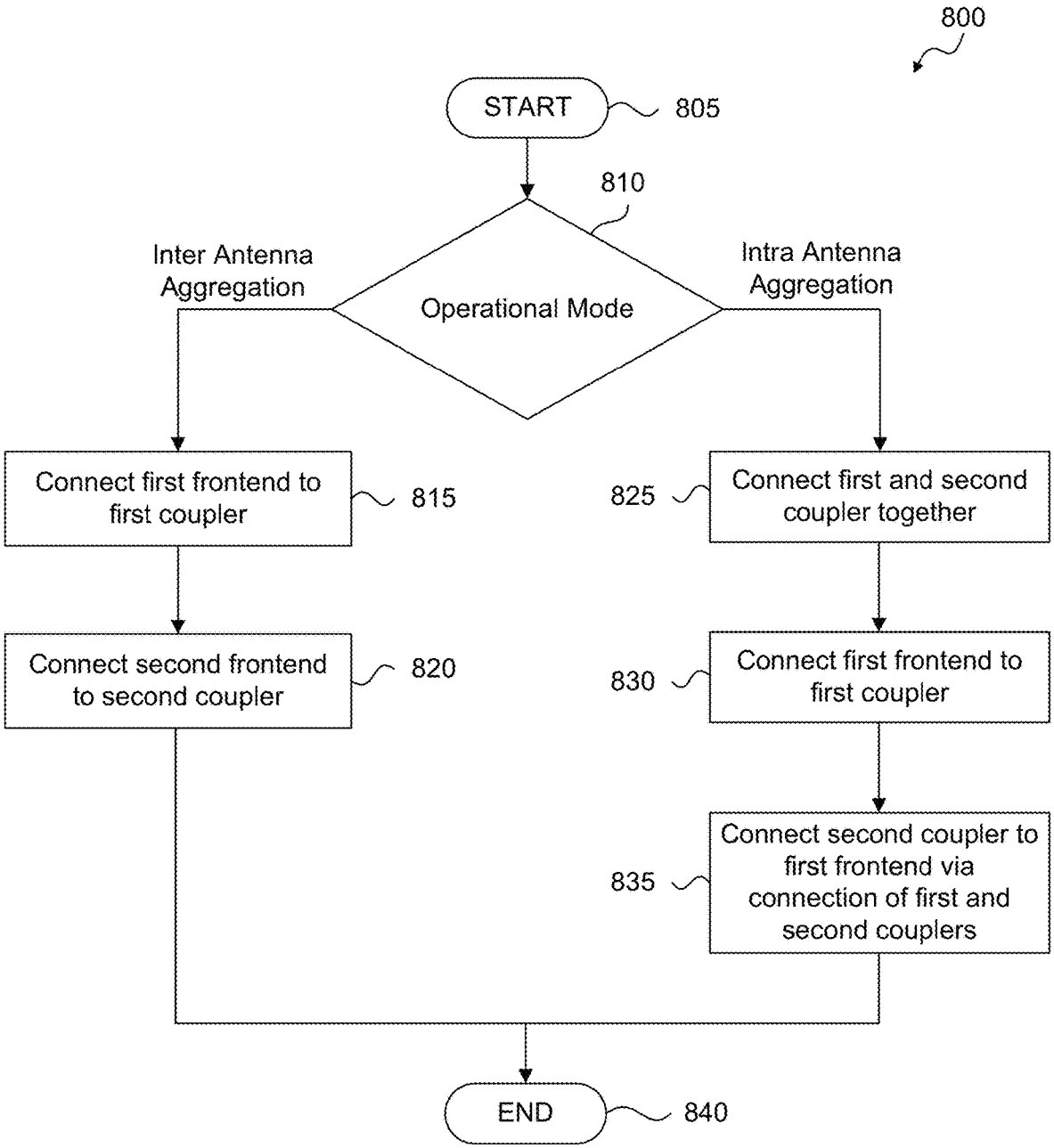
FIG. 8 illustrates a method for configuring an antenna system according to an exemplary aspect of the present disclosure.

FIG. 8 illustrates a method 800 for configuring an antenna system according to an exemplary aspect of the present disclosure. The flowchart is described with continued reference to FIGS. 1-7B. The steps of the method are not limited to the order described below, and the various steps may be performed in a different order. Further, two or more steps of the method may be performed simultaneously with each other.

The method of flowchart 800 begins at step 805 and transitions to step 810, where the operational mode of the antenna system is determined. For example, the switch of the antenna system (e.g., switch 130) can determine the operational mode of the antenna system based on one or more control signals received by the switch. In an exemplary aspect, one or more internal and/or external controllers, processor circuitry, and/or one or a device (e.g., a communication device, a mobile device, etc) in which the antenna system has been implemented can be configured to generate one or more control signals to control the operation of the switch. In an exemplary aspect, the switch (e.g., switch 130, 430) can include processor circuitry configured to determine the operational mode of the antenna system. In this example, the determination by the switch can be based on one or more received signals.

If the operational mode is determined to be an inter antenna aggregation configuration, the flowchart 800 transitions to step 815. If the operational mode is determined to be an intra antenna aggregation configuration, the flowchart 800 transitions to step 825.

At step 815, the first frontend is connected to the first electromagnetic coupler. For example, first electromagnetic coupler (e.g., 322) can be connected to a first frontend (e.g., 352). The connection can be established via the switch (e.g., first switch 331 of switch 330).

After step 815, the flowchart 800 transitions to step 820, where the second frontend is connected to the second electromagnetic coupler. For example, second electromagnetic coupler (e.g., 312) can be connected to a second frontend (e.g., 354). The connection can be established via the switch (e.g., second switch 332 of switch 330).

After step 820, the flowchart 800 transitions to step 840, where the flowchart ends.

At step 825, the first and second couplers are connected together. For example, For example, first electromagnetic coupler (e.g., 322) can be connected to the second electromagnetic coupler (e.g., 312). The connection can be established via the switch (e.g., third switch 333 of switch 330).

After step 825, the flowchart 800 transitions to step 830, where first frontend is connected to the first electromagnetic coupler. For example, first electromagnetic coupler (e.g., 322) can be connected to a first frontend (e.g., 352). The connection can be established via the switch (e.g., first switch 331 of switch 330).

After step 830, the flowchart 800 transitions to step 835, where the second electromagnetic coupler (e.g., 312) is connected to the first frontend (e.g., 352) via the connection of the first and second electromagnetic couplers (e.g., the connection established by the third switch 333 of switch 330). In this example, by connecting both the first and second couplers to the first frontend, the antenna system can be configured in a high-band intra antenna aggregation mode when the first frontend, the first coupler, and the second coupler represent a high-band electromagnet coupler (e.g., 312), a high-band frontend (e.g., 354), and a mid-band electromagnetic coupler (e.g., 322), respectively. Similarly, the antenna system can be configured in a mid-band intra antenna aggregation mode when the first frontend, the first coupler, and the second coupler represent a mid-band electromagnet coupler (e.g., 322), a mid-band frontend (e.g., 352), and a high-band electromagnetic coupler (e.g., 312), respectively.

After step 835, the flowchart 800 transitions to step 840, where the flowchart ends. The flowchart 800 may be repeated one or more times. If repeated, the flowchart can return to step 810.

EXAMPLES

Example 1 is an antenna system for wireless communication, comprising: a first radiator having a first resonance frequency; a second radiator having a second resonance frequency different from the first resonance frequency; a first electromagnetic coupler associated with the first radiator and a first frontend; a second electromagnetic coupler associated with the second radiator and a second frontend; and a switch configured to: connect the first electromagnetic coupler and the second electromagnetic coupler in an inter antenna aggregation configuration in a first mode of operation; and connect the first electromagnetic coupler and the second electromagnetic coupler in an intra antenna aggregation configuration in a second mode of operation.

In Example 2, the subject matter of Example 1, wherein, in the inter antenna aggregation configuration, the switch is configured to: connect the first frontend to the first electromagnetic coupler, and connect the second frontend to the second electromagnetic coupler.

In Example 3, the subject matter of Example 1, wherein, in the intra antenna aggregation configuration, the switch is configured to: connect the first and second electromagnetic couplers together, connect the first electromagnetic coupler to the first frontend, and connect the second electromagnetic coupler to the first frontend via the connection of the first and second electromagnetic couplers.

In Example 4, the subject matter of Example 1, wherein: in the inter antenna aggregation configuration, the switch is configured to: connect the first frontend to the first electromagnetic coupler, and connect the second frontend to the second electromagnetic coupler; and in the intra antenna aggregation configuration, the switch is configured to:

connect the first and second electromagnetic couplers together, connect the first electromagnetic coupler to the first frontend, and connect the second electromagnetic coupler to the first frontend via the connection of the first and second electromagnetic couplers.

In Example 5, the subject matter of Example 1, wherein the switch comprises: a first switch configured to connect the second electromagnetic coupler to the second frontend; and a second switch configured to connect the first and second electromagnetic couplers together.

In Example 6, the subject matter of Example 5, wherein the switch further comprises: a third switch configured to connect the first electromagnetic coupler to first frontend.

In Example 7, the subject matter of Example 1, further comprising a first tuning device connected to the first radiator, the first tuning device being configured to tune the first radiator within a first frequency range; and a second tuning device connected to the second radiator, the second tuning device being configured to tune the second radiator within a second frequency range different from the first frequency range.

In Example 8, the subject matter of Example 1, wherein the first radiator and the second electromagnetic coupler are disposed on a first surface of a printed circuit board (PCB), and the second radiator and the first electromagnetic coupler are disposed on a second surface of the PCB opposite the first surface of the PCB.

In Example 9, the subject matter of Example 8, wherein: the first electromagnetic coupler at least partially overlaps the first radiator and the second electromagnetic coupler in a direction substantially perpendicular to the first and second surfaces; and the first radiator at least partially overlaps the second electromagnetic coupler in the direction substantially perpendicular to the first and second surfaces.

In Example 10, the subject matter of Example 1, wherein the second radiator and the first electromagnetic coupler are disposed on a first surface of a printed circuit board (PCB), and the first radiator and the second electromagnetic coupler are disposed on a second surface of the PCB opposite the first surface of the PCB.

In Example 11, the subject matter of Example 10, wherein the first electromagnetic coupler and the first radiator are spaced apart from the second electromagnetic coupler and the second radiator in a direction substantially parallel to the first and the second surfaces of the PCB.

Example 12 is an antenna system for wireless communication, comprising: a first frontend associated with a first frequency range; a second frontend associated with a second frequency range different from the first frequency range; a first radiator having a first resonance frequency; a second radiator having a second resonance frequency different from the first resonance frequency; and a switch configured to: in a first mode of operation, connect the first and second radiators to the first frontend, and disconnect the first and second radiators from the second frontend; and in a second mode of operation, connect the first radiator to the first frontend and disconnect the first radiator from the second frontend, and connect the second radiator to the second frontend and disconnect the second radiator from the first frontend.

In Example 13, the subject matter of Example 12, further comprising: a first electromagnetic coupler configured to couple with the first radiator; and a second electromagnetic coupler configured to couple with the second radiator.

In Example 14, the subject matter of Example 12, wherein the switch comprises: a first switch configured to connect the first radiator to the first frontend; a second switch configured to connect the second radiator to the second frontend; and a third switch configured to connect the first and second radiators together and to a same one of the first and second frontends.

In Example 15, the subject matter of Example 12, further comprising: a first tuning device connected to the first radiator, the first tuning device being configured to tune the first radiator within the first frequency range; and a second tuning device connected to the second radiator, the second tuning device being configured to tune the second radiator within the second frequency range different from the first frequency range.

In Example 16, the subject matter of Example 12, wherein the first radiator and the first electromagnetic coupler are disposed on a first surface of a printed circuit board (PCB), and the second radiator and the second electromagnetic coupler are disposed on a second surface of the PCB opposite the first surface of the PCB.

In Example 17, the subject matter of Example 16, wherein: the first electromagnetic coupler at least partially overlaps the second radiator and the second electromagnetic coupler in a direction substantially perpendicular to the first and second surfaces; and the first radiator at least partially overlaps the second electromagnetic coupler in the direction substantially perpendicular to the first and second surfaces.

In Example 18, the subject matter of Example 12, wherein the second radiator and the first electromagnetic coupler are disposed on a first surface of a printed circuit board (PCB), and the first radiator and the second electromagnetic coupler are disposed on a second surface of the PCB opposite the first surface of the PCB.

In Example 19, the subject matter of Example 18, wherein the first electromagnetic coupler and the first radiator are spaced apart from the second electromagnetic coupler and the second radiator in a direction substantially parallel to the first and the second surfaces of the PCB.

Example 20 is a method for configuring an antenna system including first and second electromagnetic couplers, first and second radiators, and first and second frontends, the method comprising: determining an operational mode of the antenna system; in a first mode of operation: connecting the first frontend to the first electromagnetic coupler, and connecting the second frontend to the second electromagnetic coupler; and in a second mode of operation: connecting the first and second electromagnetic couplers together, connecting the first electromagnetic coupler to the first frontend, and connecting the second electromagnetic coupler to the first frontend via the connection of the first and second electromagnetic couplers.

In Example 21, the subject matter of Example 20, wherein the first mode of operation is an inter antenna aggregation configuration, and the second mode of operation is an intra antenna aggregation configuration.

In Example 2, the subject matter of any of Examples 1 and 2, wherein, in the intra antenna aggregation configuration, the switch is configured to: connect the first and second electromagnetic couplers together, connect the first electromagnetic coupler to the first frontend, and connect the second electromagnetic coupler to the first frontend via the connection of the first and second electromagnetic couplers.

In Example 23, the subject matter of any of Example 1-4, wherein the switch comprises: a first switch configured to connect the second electromagnetic coupler to the second frontend; and a second switch configured to connect the first and second electromagnetic couplers together.

In Example 24, the subject matter of Example 23, wherein the switch further comprises: a third switch configured to connect the first electromagnetic coupler to first frontend.

In Example 25, the subject matter of any of Examples 1-6, further comprising: a first tuning device connected to the first radiator, the first tuning device being configured to tune the first radiator within a first frequency range; and a second tuning device connected to the second radiator, the second tuning device being configured to tune the second radiator within a second frequency range different from the first frequency range.

In Example 26, the subject matter of any of Examples 1-7, wherein the first radiator and the second electromagnetic coupler are disposed on a first surface of a printed circuit board (PCB), and the second radiator and the first electromagnetic coupler are disposed on a second surface of the PCB opposite the first surface of the PCB.

In Example 27, the subject matter of Example 26, wherein: the first electromagnetic coupler at least partially overlaps the first radiator and the second electromagnetic coupler in a direction substantially perpendicular to the first and second surfaces; and the first radiator at least partially overlaps the second electromagnetic coupler in the direction substantially perpendicular to the first and second surfaces.

In Example 28, the subject matter of any of Examples 1-9, wherein the second radiator and the first electromagnetic coupler are disposed on a first surface of a printed circuit board (PCB), and the first radiator and the second electromagnetic coupler are disposed on a second surface of the PCB opposite the first surface of the PCB.

In Example 29, the subject matter of Example 28, wherein the first electromagnetic coupler and the first radiator are spaced apart from the second electromagnetic coupler and the second radiator in a direction substantially parallel to the first and the second surfaces of the PCB.

Example 30 is an antenna system for wireless communication, comprising: a first radiator means having a first resonance frequency; a second radiator means having a second resonance frequency different from the first resonance frequency; a first electromagnetic coupling means associated with the first radiator and a first frontend; a second electromagnetic coupling means associated with the second radiator and a second frontend; and a switching means for: connecting the first electromagnetic coupler and the second electromagnetic coupler in an inter antenna aggregation configuration in a first mode of operation; and connecting the first electromagnetic coupler and the second electromagnetic coupler in an intra antenna aggregation configuration in a second mode of operation.

In Example 31, the subject matter of Example 30, wherein, in the intra antenna aggregation configuration, the switching means: connects the first and second electromagnetic couplers together, connects the first electromagnetic coupler to the first frontend, and connects the second electromagnetic coupler to the first frontend via the connection of the first and second electromagnetic couplers.

In Example 32, the subject matter of any of Examples 30 and 31, wherein, in the inter antenna aggregation configuration, the switching means: connects the first frontend to the first electromagnetic coupler, and connects the second frontend to the second electromagnetic coupler.

In Example 33, the subject matter of Example 30, wherein the switching means comprises: a first switch configured to connect the second electromagnetic coupler to the second frontend; and a second switch configured to connect the first and second electromagnetic couplers together.

In Example 34, the subject matter of Example 33, wherein the switching means further comprises: a third switch configured to connect the first electromagnetic coupler to first frontend.

In Example 35, the subject matter of any of Examples 30, 31, 33, and 34, further comprising: a first tuning means connected to the first radiating means, the first tuning means for tuning the first radiating means within a first frequency range; and a second tuning means connected to the second radiating means, the second tuning means for tuning the second radiating means within a second frequency range different from the first frequency range.

In Example 36, the subject matter of any of Examples 30, 31, 33, and 34, wherein the first radiating means and the second electromagnetic coupling means are disposed on a first surface of a printed circuit board (PCB), and the second radiating means and the first electromagnetic coupling means are disposed on a second surface of the PCB opposite the first surface of the PCB.

In Example 37, the subject matter of Example 36, wherein: the first electromagnetic coupling means at least partially overlaps the first radiating means and the second electromagnetic coupling means in a direction substantially perpendicular to the first and second surfaces; and the first radiating means at least partially overlaps the second electromagnetic coupling means in the direction substantially perpendicular to the first and second surfaces.

In Example 38, the subject matter of any of Examples 30, 31, 33, and 34, wherein the second radiating means and the first electromagnetic coupling means are disposed on a first surface of a printed circuit board (PCB), and the first radiating means and the second electromagnetic coupling means are disposed on a second surface of the PCB opposite the first surface of the PCB.

In Example 39, the subject matter of Example 38, wherein the first electromagnetic coupling means and the first radiating means are spaced apart from the second electromagnetic coupling means and the second radiating means in a direction substantially parallel to the first and the second surfaces of the PCB.

Example 40 is an apparatus comprising means to perform the method as claimed in any of Examples 20-21.

Example 41 is a machine-readable storage including machine-readable instructions, when executed, implements a method or realizes an apparatus as set forth in any of Examples 1-21.

Example 42 is an apparatus substantially as shown and described.

CONCLUSION

The aforementioned description of the specific aspects will so fully reveal the general nature of the disclosure that others can, by applying knowledge within the skill of the art, readily modify and/or adapt for various applications such specific aspects, without undue experimentation, and without departing from the general concept of the present disclosure. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one aspect," "an aspect," "an exemplary aspect," etc., indicate that the aspect described may include a particular feature, structure, or characteristic, but every aspect may not necessarily include the particular feature, structure, or characteristic. Moreover, such phrases are not necessarily referring to the same aspect. Further, when a particular feature, structure, or characteristic is described in connection with an aspect, it is submitted that it is within the knowledge of one skilled in the art to affect such feature, structure, or characteristic in connection with other aspects whether or not explicitly described.

The exemplary aspects described herein are provided for illustrative purposes, and are not limiting. Other exemplary aspects are possible, and modifications may be made to the exemplary aspects. Therefore, the specification is not meant to limit the disclosure. Rather, the scope of the disclosure is defined only in accordance with the following claims and their equivalents.

Aspects may be implemented in hardware (e.g., circuits), firmware, software, or any combination thereof. Aspects may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. The processor can be "hard-coded" with instructions to perform corresponding function(s) according to aspects described herein. Alternatively, the processor can access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary aspects described herein, processor circuitry can include memory that stores data and/or instructions. The memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

The term "module" shall be understood to include one of software, firmware, hardware (such as circuits, microchips, processors, or devices, or any combination thereof), or any combination thereof. In addition, it will be understood that each module can include one or more components within an actual device, and each component that forms a part of the described module can function either cooperatively or independently of any other component forming a part of the module. Conversely, multiple modules described herein can represent a single component within an actual device. Further, components within a module can be in a single device or distributed among multiple devices in a wired or wireless manner.

One or more of the exemplary aspects described herein can be implemented using one or more wireless communications conforming to one or more communication standards/protocols, including (but not limited to), Long-Term Evolution (LTE), Evolved High-Speed Packet Access (HSPA+), Wideband Code Division Multiple Access (W-CDMA), CDMA2000, Time Division-Synchronous Code Division Multiple Access (TD-SCDMA), Global System for Mobile Communications (GSM), General Packet Radio Service (GPRS), Enhanced Data Rates for GSM Evolution (EDGE), and/or Worldwide Interoperability for Microwave Access (WiMAX) (IEEE 802.16), to one or more non-cellular communication standards, including (but not limited to) WLAN (IEEE 802.11), Bluetooth, Near-field Communication (NFC) (ISO/IEC 18092), ZigBee (IEEE 802.15.4), Radio-frequency identification (RFID), and/or to one or more well-known navigational system protocols, including the Global Navigation Satellite System (GNSS), the Russian Global Navigation Satellite System (GLONASS), the European Union Galileo positioning system (GALILEO), the Japanese Quasi-Zenith Satellite System (QZSS), the Chinese BeiDou navigation system, and/or the Indian Regional Navigational Satellite System (IRNSS) to provide some examples. These various standards and/or protocols are each incorporated herein by reference in their entirety.

What is claimed is:

1. An antenna system for wireless communication, comprising:

a first radiator having a first resonance frequency;

a second radiator having a second resonance frequency different from the first resonance frequency;

a first electromagnetic coupler associated with the first radiator and a first frontend;

a second electromagnetic coupler associated with the second radiator and a second frontend, the first radiator and the second electromagnetic coupler being disposed on a first surface of a printed circuit board (PCB), and the second radiator and the first electromagnetic coupler being disposed on a second surface of the PCB opposite the first surface of the PCB, wherein the first electromagnetic coupler at least partially overlaps the first radiator and the second electromagnetic coupler in a direction substantially perpendicular to the first and second surfaces, and the second radiator at least partially overlaps the second electromagnetic coupler in the direction substantially perpendicular to the first and second surfaces; and a switch configured to:

connect the first electromagnetic coupler and the second electromagnetic coupler in an inter antenna aggregation configuration in a first mode of operation; and connect the first electromagnetic coupler and the second electromagnetic coupler in an intra antenna aggregation configuration in a second mode of operation.

2. The antenna system of claim 1, wherein, in the inter antenna aggregation configuration, the switch is configured to:

connect the first frontend to the first electromagnetic coupler, and connect the second frontend to the second electromagnetic coupler.

3. The antenna system of claim 1, wherein, in the intra antenna aggregation configuration, the switch is configured to:

connect the first and second electromagnetic couplers together, connect the first electromagnetic coupler to the first frontend, and connect the second electromagnetic coupler to the first frontend via the connection of the first and second electromagnetic couplers.

4. The antenna system of claim 1, wherein:

in the inter antenna aggregation configuration, the switch is configured to:

connect the first frontend to the first electromagnetic coupler, and connect the second frontend to the second electromagnetic coupler; and in the intra antenna aggregation configuration, the switch is configured to:

connect the first and second electromagnetic couplers together, connect the first electromagnetic coupler to the first frontend, and connect the second electromagnetic coupler to the first frontend via the connection of the first and second electromagnetic couplers.

5. The antenna system of claim 1, wherein the switch comprises:

a first switch configured to connect the second electromagnetic coupler to the second frontend; and a second switch configured to connect the first and second electromagnetic couplers together.

6. The antenna system of claim 5, wherein the switch further comprises:

a third switch configured to connect the first electromagnetic coupler to first frontend.

7. The antenna system of claim 1, further comprising:

a first tuning device connected to the first radiator, the first tuning device being configured to tune the first radiator within a first frequency range; and a second tuning device connected to the second radiator, the second tuning device being configured to tune the second radiator within a second frequency range different from the first frequency range.

8. The antenna system of claim 1, wherein the second radiator and the first electromagnetic coupler are disposed on a first surface of a printed circuit board (PCB), and the first radiator and the second electromagnetic coupler are disposed on a second surface of the PCB opposite the first surface of the PCB.

9. The antenna system of claim 8, wherein the first electromagnetic coupler and the first radiator are spaced apart from the second electromagnetic coupler and the second radiator in a direction substantially parallel to the first and the second surfaces of the PCB.

10. The antenna system of claim 1, wherein, in the inter antenna aggregation configuration, the switch is configured to connect the first and second radiators to the first frontend, and disconnect the first and second radiators from the second frontend.

11. The antenna system of claim 1, wherein, in the intra antenna aggregation configuration, the switch is configured to:

connect the first radiator to the first frontend and disconnect the first radiator from the second frontend, and connect the second radiator to the second frontend and disconnect the second radiator from the first frontend.

12. The antenna system of claim 1, wherein:

in the inter antenna aggregation configuration, the switch is configured to connect the first and second radiators to the first frontend, and disconnect the first and second radiators from the second frontend; and in the intra antenna aggregation configuration, the switch is configured to:

connect the first radiator to the first frontend and disconnect the first radiator from the second frontend, and connect the second radiator to the second frontend and disconnect the second radiator from the first frontend.

13. The antenna system of claim 1, wherein the first frontend is associated with a first frequency range, and the second frontend is associated with a second frequency range different from the first frequency range.

14. An antenna system for wireless communication, comprising:

a first radiator having a first resonance frequency;

a second radiator having a second resonance frequency different from the first resonance frequency;

a first electromagnetic coupler associated with the first radiator and a first frontend;

a second electromagnetic coupler associated with the second radiator and a second frontend, the second radiator and the first electromagnetic coupler being disposed on a first surface of a printed circuit board (PCB), and the first radiator and the second electromagnetic coupler being disposed on a second surface of the PCB opposite the first surface of the PCB, wherein the first electromagnetic coupler and the first radiator are spaced apart from the second electromagnetic coupler and the second radiator in a direction substantially parallel to the first and the second surfaces of the PCB; and a switch configured to:

connect the first electromagnetic coupler and the second electromagnetic coupler in an inter antenna aggregation configuration in a first mode of operation; and connect the first electromagnetic coupler and the second electromagnetic coupler in an intra antenna aggregation configuration in a second mode of operation.

15. The antenna system of claim 14, wherein, in the inter antenna aggregation configuration, the switch is configured to:

connect the first frontend to the first electromagnetic coupler, and connect the second frontend to the second electromagnetic coupler.

16. The antenna system of claim 14, wherein, in the intra antenna aggregation configuration, the switch is configured to:

connect the first and second electromagnetic couplers together, connect the first electromagnetic coupler to the first frontend, and connect the second electromagnetic coupler to the first frontend via the connection of the first and second electromagnetic couplers.

17. The antenna system of claim 14, wherein:

in the inter antenna aggregation configuration, the switch is configured to:

connect the first frontend to the first electromagnetic coupler, and connect the second frontend to the second electromagnetic coupler; and in the intra antenna aggregation configuration, the switch is configured to:

connect the first and second electromagnetic couplers together, connect the first electromagnetic coupler to the first frontend, and connect the second electromagnetic coupler to the first frontend via the connection of the first and second electromagnetic couplers.

18. The antenna system of claim 14, wherein the switch comprises:

a first switch configured to connect the second electromagnetic coupler to the second frontend; and a second switch configured to connect the first and second electromagnetic couplers together.

19. The antenna system of claim 18, wherein the switch further comprises:

a third switch configured to connect the first electromagnetic coupler to first frontend.

20. The antenna system of claim 14, further comprising:

a first tuning device connected to the first radiator, the first tuning device being configured to tune the first radiator within a first frequency range; and a second tuning device connected to the second radiator, the second tuning device being configured to tune the second radiator within a second frequency range different from the first frequency range.

* * * * *